US007762640B2

(12) United States Patent
Kanda et al.

(10) Patent No.: US 7,762,640 B2
(45) Date of Patent: Jul. 27, 2010

(54) INK JET PRINTING APPARATUS AND INK JET PRINTING METHOD

(75) Inventors: Hidehiko Kanda, Kanagawa-ken (JP); Yoshinori Nakajima, Kanagawa-ken (JP); Yoshinori Nakagawa, Kanagawa-ken (JP); Jiro Moriyama, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 11/002,902

(22) Filed: Dec. 3, 2004

(65) Prior Publication Data

US 2005/0122355 A1 Jun. 9, 2005

(30) Foreign Application Priority Data

Dec. 9, 2003 (JP) ..... 2003-411062

(51) Int. Cl.
*B41J 29/38* (2006.01)
*B41J 2/205* (2006.01)

(52) U.S. Cl. ..... 347/12; 347/9; 347/15

(58) Field of Classification Search ..... 347/9, 347/12, 15

See application file for complete search history.

(56) References Cited

U.S. PATENT DOCUMENTS 5,739,828 A 4/1998 Moriyama et al.
5,847,721 A * 12/1998 Ogata et al. ..... 347/9
5,980,012 A 11/1999 Fujita et al.
6,203,133 B1 3/2001 Tanaka et al.
6,309,051 B1 10/2001 Koitabashi et al.
2002/0154183 A1* 10/2002 Mizutani ..... 347/12
2004/0021717 A1 2/2004 Nakajima et al.
2004/0090477 A1* 5/2004 Faken ..... 347/12
2004/0090480 A1* 5/2004 Teshikawara et al. ..... 347/15
2004/0090515 A1* 5/2004 Matsushiro et al. ..... 347/130

FOREIGN PATENT DOCUMENTS

JP 8-183179 7/1996
JP 946522 2/1997

* cited by examiner

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

One pixel is sub-divided on the basis of ejection ports. Pixel patterns are provided at respective quantization levels, each of which are defined using dots having different sizes. Image data is processed using a pixel pattern selected according to the type of printing medium and image quality to be achieved, and printing is performed using the image data. Only ejection ports ejecting ink droplets in the same size are driven at the same timing for ejection.

19 Claims, 17 Drawing Sheets

INK JET PRINTING APPARATUS AND INK JET PRINTING METHOD

BACKGROUND OF THE INVENTION

1. Field of the Invention

The present invention relates to an ink jet printing apparatus and an ink jet printing method and, more particularly, to an ink jet printing apparatus and an ink jet printing method in which the amount of ink ejected from a printing head onto a printing medium can be varied for each of ejection ports of the printing head.

2. Description of the Related Art

Printing apparatus included in printers, copiers, and facsimile machines and things like that and printing apparatus used as output apparatus for composite electronic equipment including a computer or word processor or workstations or the like are configured to print images (including characters and the like) on a printing surface of a printing medium such as a sheet of paper or a plastic thin plate based on image information (including character information and the like). Printing apparatus are generally categorized into ink jet type, wire-dot type, thermal type, and laser beam type apparatus according to the printing method. Among those printing apparatus, ink jet type printing apparatus (hereinafter referred to as "ink jet printing apparatus") perform printing by ejecting ink from an ink ejecting unit of a printing head onto a printing medium. In comparison to other types of printing, ink jet printing apparatus are characterized in that high definition can be easily achieved; high speed and quietness is excellently achieved; and they are provided at a low cost. The spread of color scanners and digital cameras has resulted in increasing needs for color printing. Many ink jet printing apparatus capable of color printing have been developed to satisfy such needs.

In order to achieve an improved printing speed, an ink jet printing apparatus has a printing head provided with a plurality of printing elements integrated and arranged. The printing head used is a unit obtained by integrating a plurality of ink ejection ports and liquid channels as ink ejecting units. In general, an ink jet printing apparatus has a plurality of printing heads to support for color printing.

FIG. 1 shows a configuration of a printing unit of an ink jet printing apparatus for performing printing on a printing surface of a printing medium P. In the same figure, reference numeral 101 represents an ink cartridge. The ink cartridge 101 has ink tanks which are filled with inks in four colors, e.g., black, cyan, magenta, and yellow, respectively, and a printing head 102 having an ejection port array for each ink color. An ejection port array of the printing head 102 is an arrangement of a plurality of ejection ports. The printing head 102 performs printing by ejecting ink droplets from each of the ejection ports.

FIG. 2 is a view of one of the ejection port arrays taken in the direction z in FIG. 1. Reference numeral 201 represents a plurality of ejection ports arranged to constitute the ejection port array. In one ejection form among a plurality of forms of ejection that are available, for example, in a configuration in which a heating-heater is provided in the vicinity of each ejection port, heat is generated at the this heating-heater to generate bubbles in ink when the ink is ejected, and the ink is ejected by a pressure generated by the bubbles. Other forms of ejection include a piezoelectric form or the like.

Referring again to FIG. 1, reference numeral 103 represents a sheet conveying roller which rotates in the direction of the arrow in the figure while holding the printing medium P in cooperation with an auxiliary roller represented by 104. As a result, the printing medium P is conveyed in the direction y in accordance with a printing operation of the printing head 102. Reference numeral 105 represents a pair of sheet feeding rollers which feeds the printing medium P and also plays a role of holding the printing medium P similarly to the sheet conveying roller 103 and the auxiliary roller 104. Reference numeral 106 represents a carriage which supports the four ink cartridges 101 and which moves the cartridges in the direction of the arrow x during printing. The carriage 106 is moved in the direction of the arrow x by driving means and drive controlling means which are omitted in the illustration. The carriage 106 stands by in a home position (h) indicated by the dotted line in the figure when printing is not performed or when an operation of recovering the printing head 102. Specifically, when a printing start instruction from the drive control means arrives the carriage 106 which is in the home position h before printing is started, the carriage 106 is moved in the direction of the arrow x, and the printing head 102 of the ink cartridge 101 ejects ink droplets from the plurality of ejection ports 201 based on data supplied thereto to perform printing. When the data is recorded by the printing head 102 up to an end of the printing surface of the printing medium P, the carriage 106 is returned to the home position h, and the sheet conveying roller 103 conveys the printing medium P by a predetermined amount. Printing; and sheet conveying are alternately repeated in such a manner to perform printing on the entire printing surface of the printing medium P.

Many proposals have been made on printing apparatus in a configuration in which a plurality different-sized dots are formed on a printing surface of a printing medium in order to perform printing with a multiplicity of gradations.

The invention disclosed in Japanese Patent Application Laid-Open No. 8-183179(1996) discloses a configuration which ink droplets to be ejected from one ejection port are changed into a plurality different-sized dots to eject(e.g. in FIG. 4, a configuration in which a plurality of heaters are located in an ejection port is disclosed). The above official gazette discloses that plural different-sized ink droplets can be ejected from ejection ports corresponding to sizes of ink droplets ejected (e.g. see FIGS. 21 to 26).

SUMMARY OF THE INVENTION

Like the above-described invention, dots in different sizes can be freely printed at a randomly chosen point on a printing medium by a structure capable of varying an amount of ejection.

However, with a structure for controlling an amount of an ink droplet ejected per each ejection port, there is the need for varying a signal applied depending on each ejection port with respect to a numerous of ejection ports of a printing head and for adjusting an applying timing, resulting in to provide a complicated control. Also, like the above-described invention, with a configuration in which a plurality of heaters are located in ejection ports, there is the need for locating heaters accurately and for providing a wiring corresponding to each heater. Thus, there is a possibility of increasing a manufacturing cost of a printing head. In view of the above, in terms of simplifying control and cost, it can be considered that a printing head is provided with ejection ports corresponding to respective ink droplets among plural different-sized ink droplet.

Like the above-described invention, however, with a structure which a printing head is provided with ejection ports corresponding to a small and a large dot size, a location of an ejection port ejecting large-sized ink droplets and a location of an ejection port ejecting small-sized ink droplets are determined. Therefore, rows of a large-sized dot and a small-sized dot formed on a printing medium is determined according to the arrangement of the large-sized ejection port and the small-sized ejection port of a printing head. That is, a printed image, which is printed on a printing surface, is always constituted by a combination of large-sized dots and small-sized dots regardless of the type of the image data and the printing medium and regardless of the condition of image quality to be printed.

A fine adjustment cannot be sufficiently made according to the type of the printing medium and the characteristics of an image to be printed, simply by sequentially varying the size of ink droplets correspond to the arrangement of ejection ports as thus described, thus making it is impossible to obtain a printed image of high quality.

Further, printing methods according to the related art in which large-sized dots and small-sized dots are combined according to a predetermined alignment, include no proposal of a method referred to as a multi-pass printing method in which image data is thinned out by using a mask or the like and in which a printing head is scanned plural times with respect to the same region to complete printing therein. Therefore, improvements in this regard present a challenge in order to obtain a printed image of high quality.

Under the circumstance, it is an object of the present invention to realize printing an image having high quality with uneven density reduced by using dots of different sizes, the image being unaffected by each of the characteristics of the image data and the type of the printing medium. It is another object to allow the quality and speed of printing to be selected and set depending on the type of the printing medium and the mode of printing required by the user. It is still another object to minimize the amount of use of a memory of a printing system and the amount of power required to drive a head and to thereby allow a printing apparatus to be provided at a low cost and with a small size.

An ink jet printing apparatus according to the present invention is an ink jet recording apparatus which performs printing by scanning a printing head having a plurality of ejection ports and which can eject ink droplets for forming dots in sizes each of which corresponds to the size of each ejection port so as to form plural types of dots in sizes and by ejecting ink from the ejection ports on to the printing medium during the scan, characterized in that it has a pixel pattern which is a pattern representing a configuration of dots in a plurality of sizes forming one pixel, image data processing means which processes image data pixel by pixel according to the pixel pattern, and printing means which performs printing based on the image data processed by the image data processing means, wherein ink droplets forming dots of the same size are ejected at the same timing of ejection during the scan as a result of the use of the pixel pattern.

An ink jet printing method according to the invention is an ink jet printing method using an ink jet printing apparatus which performs printing by scanning a printing head having a plurality of ejection ports and which can eject ink droplets for forming dots in sizes corresponding to the size of each ejection port to form plural types of dot in sizes and by ejecting ink from the ejection ports on to the printing medium during the scan, characterized in that it has a pixel patterning step for obtaining a pattern representing a configuration of dots in a plurality of sizes forming one pixel, an image data processing step for processing image data pixel by pixel according to the pixel patterning step, and a printing step for performing printing based on the image data processed at the image data processing step and in that ink droplets forming dots of the same size are ejected at the same timing of ejection in one cycle of the scan as a result of the use of the pixel pattern.

In the above-described configuration, an image of high quality without uneven density can be printed by dividing one pixel for each ejection port and providing pixel patterns configured using each of dots having different sizes and processing image data using pixel patterns selected depending on the type of the printing medium and image quality to be achieved and by printing based on processed image data. Further, the quality and speed of printing can be selected and set according to the type of the printing medium and the mode of printing through flexible and proper use of pixel patterns. The amount of use of a memory of a printing system and the amount of power required to drive a head can be minimized by elaborating the configuration of the pixel patterns, which allow a printing apparatus to be provided at a low cost and in a small size.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will now be described in detail with reference to the drawings.

Figure 17:
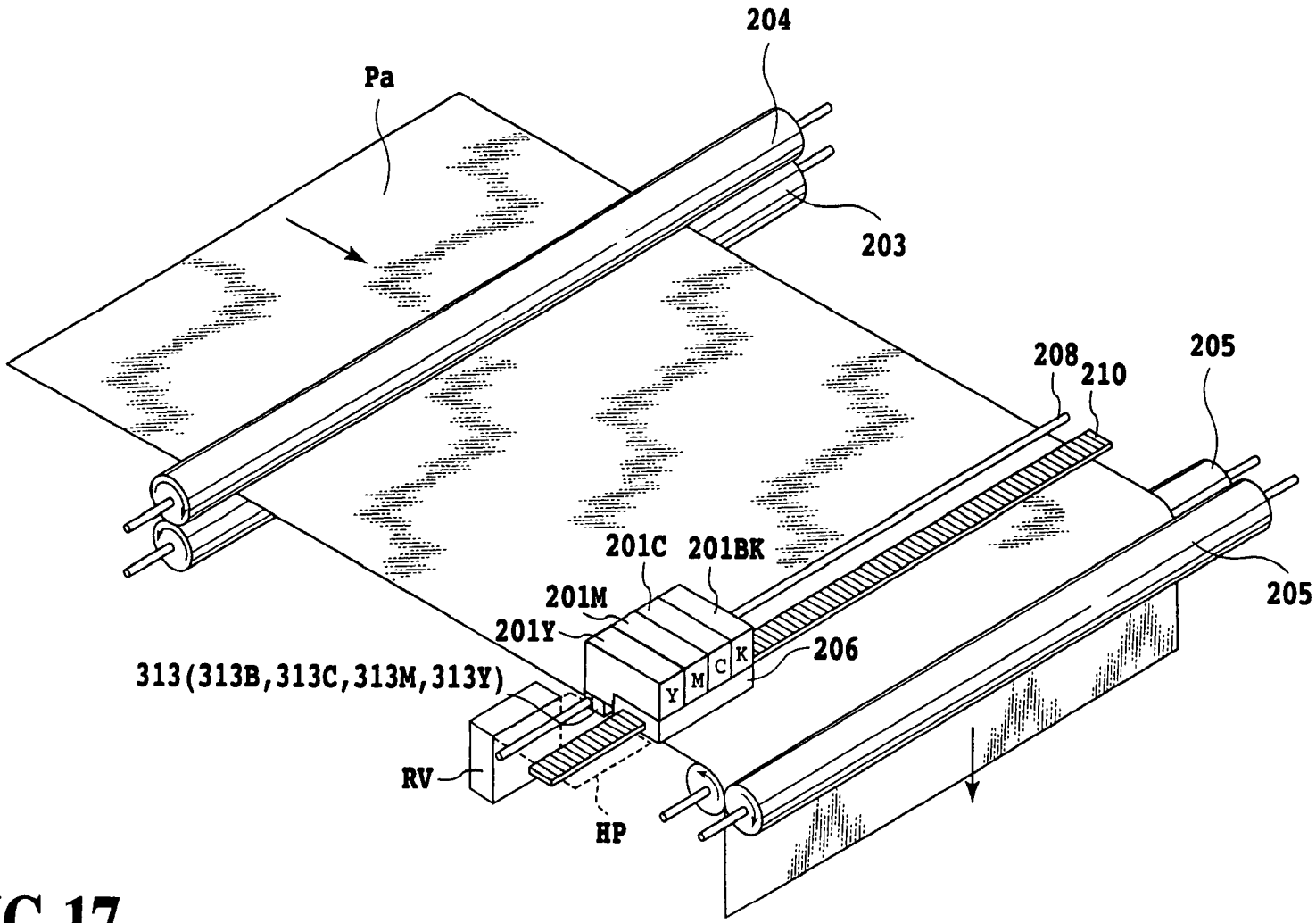
FIG. 17 is a schematic perspective view of major parts of an example of an ink jet printing apparatus according to the present invention.

FIG. 17 schematically shows major parts of an example of an ink jet printing apparatus according to an embodiment of the present invention.

In FIG. 17, the ink jet printing apparatus comprises, as major elements, a printing head unit 313 which performs a printing operation on a printing surface of a printing medium Pa, a carriage 206 on which the printing head unit 313 is removably mounted and which is moved in a direction substantially orthogonal to a conveying direction of the printing medium Pa that is indicated by the arrows, a carriage driving unit for moving the carriage 206, and a printing-medium-conveying drive unit for conveying the printing medium Pa in accordance with the printing operation of the printing head unit 313.

The printing head unit 313 comprises printing heads 313B, 313C, 313M, and 313Y which are provided in association with ink cartridges 201Bk, 201C, 201M, and 201Y containing inks in respective colors, e.g., inks in black, cyan, magenta, and yellow.

The printing heads 313B, 313C, 313M, and 313Y have an ink ejecting section in a region thereof facing the printing surface of the printing medium Pa that is disposed on a platen (not shown) provided in a printing medium conveying path. At the ink ejecting section, a plurality of ink ejecting ports for ejecting the ink contained in the ink cartridge are formed at predetermined intervals with respect to each other along the conveying direction of the printing medium Pa. Therefore, ejection port arrays of the printing heads 313B, 313C, 313M, and 313Y are arranged with respect to each other in a direction substantially orthogonal to the conveying direction of the printing medium Pa.

The printing heads 313B, 313C, 313M, and 313Y are identical to each other in structure, and they are heads of an ink jet type, e.g., a bubble jet type. Thermal insulation heaters TIH are provided on substrates of the printing heads 313B, 313C, 313M, and 313Y on which electrothermal transducers for ejecting ink are provided. By controlling the temperature of the thermal insulation heaters TIH, the temperature of the inks in the printing heads 313B, 313C, 313M, and 313Y is increased and adjusted to a desired set temperature. Diode sensors 312 are provided on the substrate. The diode sensors 312 are provided to measure the substantial ink temperature in the printing heads. The diode sensors 312 may be provided outside the substrates as long as the ink temperature can be measured, and they may alternatively be located in the vicinity of the peripheries of the printing heads 313B, 313C, 313M, and 313Y. The printing head unit 313 is controlled by a head driving control circuit 315 which will be described later.

The carriage 206 is supported by a guide shaft 208 such that it can be reciprocated. The guide shaft 208 extends above the printing medium Pa in a direction substantially orthogonal to the conveying direction thereof. A carriage moving belt 210 which forms a part of the carriage driving unit is connected to the carriage 206. The carriage moving belt 210 is disposed substantially in parallel with the guide shaft 208. Both ends of the carriage moving belt 210 are wound around respective pulleys which are omitted in the illustration. One of the pair of pulleys is connected to an output shaft of a carriage driving motor for actuating the carriage moving belt 210. The carriage driving motor is controlled by a carriage driving control circuit 316 which will be described later. Therefore, the carriage driving unit comprises the carriage moving belt 210, the pair of pulleys, and the carriage driving motor.

A home position HP, in which the carriage 206 stands by at predetermined timing, is provided in a position that is spaced from the conveying path of the printing medium Pa. A recovery processing unit RU is provided so as to face the guide shaft 208 in the vicinity of the home position HP.

The recovery processing unit RU performs a process of recovering the above-described printing heads 313B, 313C, 313M, and 313Y. The recovery processing unit RU comprises a cleaning blade 309 for wiping away ink deposited on surfaces of the printing heads 313B, 313C, 313M, and 313Y on which the ejection ports are formed, a cap 310 which covers the ejection ports of the printing heads 313B, 313C, 313M, and 313Y and to which a suction pump 311 is connected when the ejection ports of the printing heads 313B, 313C, 313M, and 313Y are recovered by suction performed by using the suction pump 311, and a recovery system motor 308 for driving a driving mechanism section for operating the cap 310, the cleaning blade 309 and the suction pump 311 in conjunction with each other. The recovery system motor 308 is controlled by a recovery system control circuit 307 which will be described later.

The printing-medium-conveying drive unit comprises a sheet conveying roller 203 and an auxiliary roller 204 which are disposed on the upstream side of the conveying path and which cooperate to pinch and deliver the printing medium Pa and a pair of sheet feeding rollers 205 which is disposed on the downstream side of the conveying path and which cooperates to pinch and deliver the printing medium Pa intermittently at predetermined timing in accordance with the printing operation of the printing heads 313B, 313C, 313M, and 313Y. An output shaft of a conveying motor is connected to one of the pair of sheet feeding rollers 205. The conveying motor is controlled by a sheet feeding control circuit 317 which will be described later.

Figure 1:
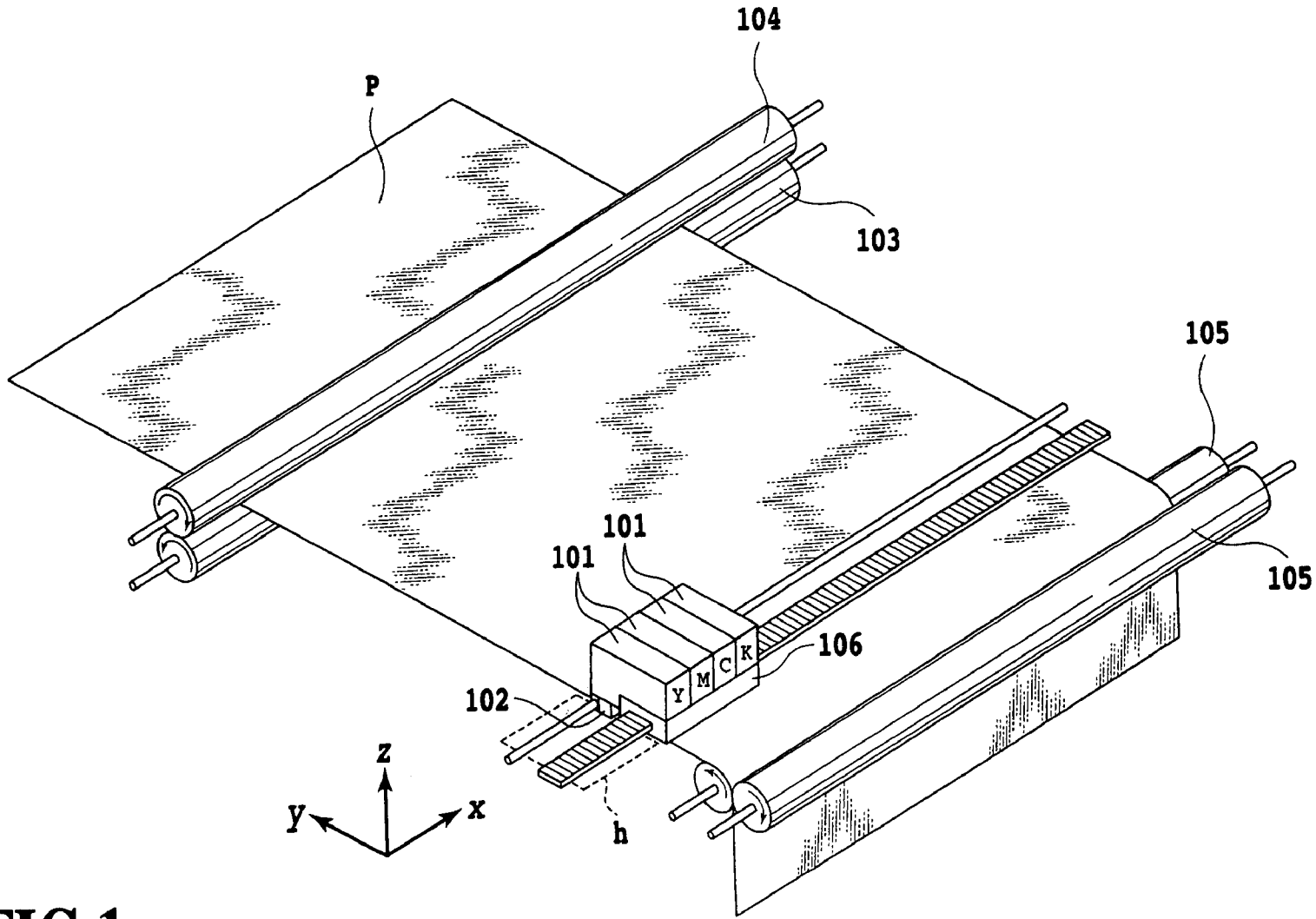
FIG. 1 is a schematic perspective view of an ink jet printing apparatus according to the related art showing a configuration of the same.
Figure 2:
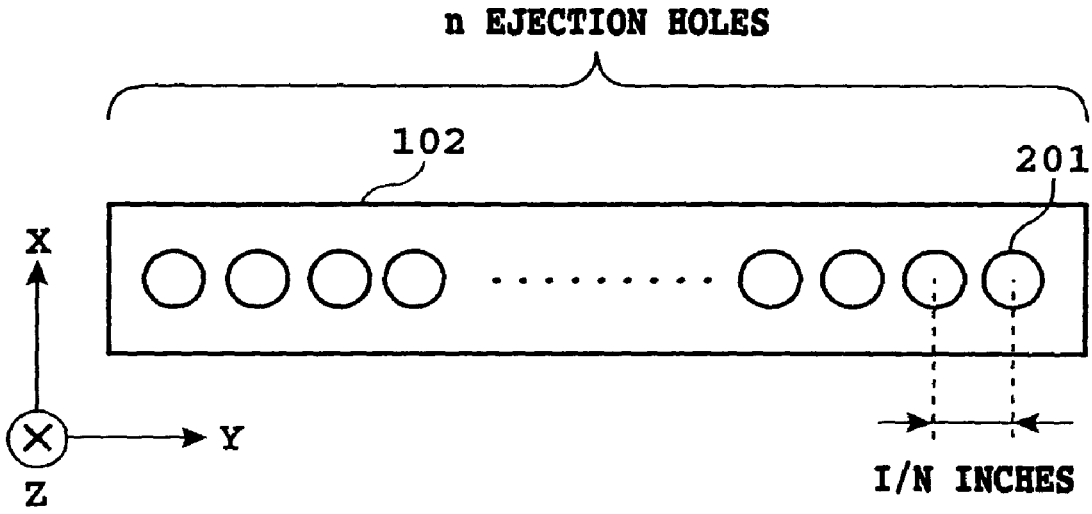
FIG. 2 is a schematic view of an ejection port array of a printing head which can be applied to the present invention.
Figure 3:
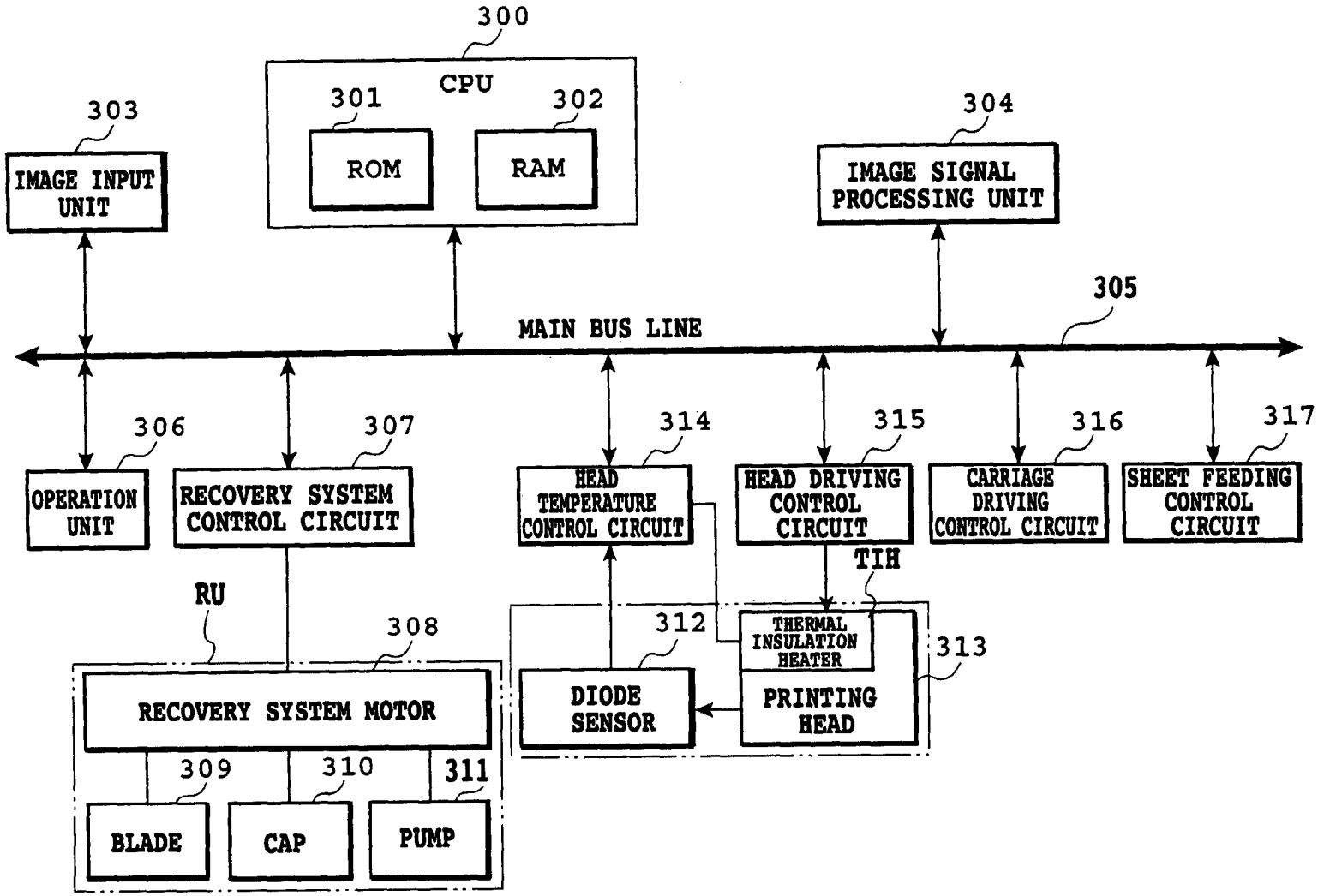
FIG. 3 is a block diagram showing an electrical configuration of an ink jet printing apparatus to which the present invention can be applied.

FIG. 3 is a block diagram showing a configuration for controlling the ink jet printing apparatus according to the embodiment of the present invention.

Reference numeral 300 represents a CPU which controls an ink jet printing apparatus as a whole. The CPU 300 has a ROM(read only memory) 301 and a random access memory (RAM) 302. The CPU 300 sends drive commands to each driving section through a main bus line 305. Further, the CPU 300 can access each of software type data processing means such as an image input unit 303 and an image signal processing unit 304 connected to the main bus line 305 and hardware type data processing means such as, an operation unit 306, the recovery system control circuit 307, an ink jet head temperature control circuit 314 for controlling the thermal insulation heater TIH based on detection outputs from the diode sensors 312, the head driving control circuit 315, the carriage driving control circuit 316, and the sheet feeding control circuit 317.

A program for executing a head recovery timing chart is stored in advance in the RAM 302. Data representing recovery conditions such as a preparatory ejection condition is supplied to each of the recovery system control circuit 307, the head temperature control circuit 314 for controlling the printing head unit 313 or the thermal insulation heaters TIH, and the head driving control circuit 315 as occasions demand.

The head driving control circuit 315 drives the electrothermal transducers for ink ejection in the printing head unit 313 according to a predetermined driving condition to cause the printing head unit 313 to perform preparatory ejection or ejection of printing ink.

Several embodiments of the present invention which are based on the above-described apparatus configuration will now be described.

First Embodiment

Figure 4:
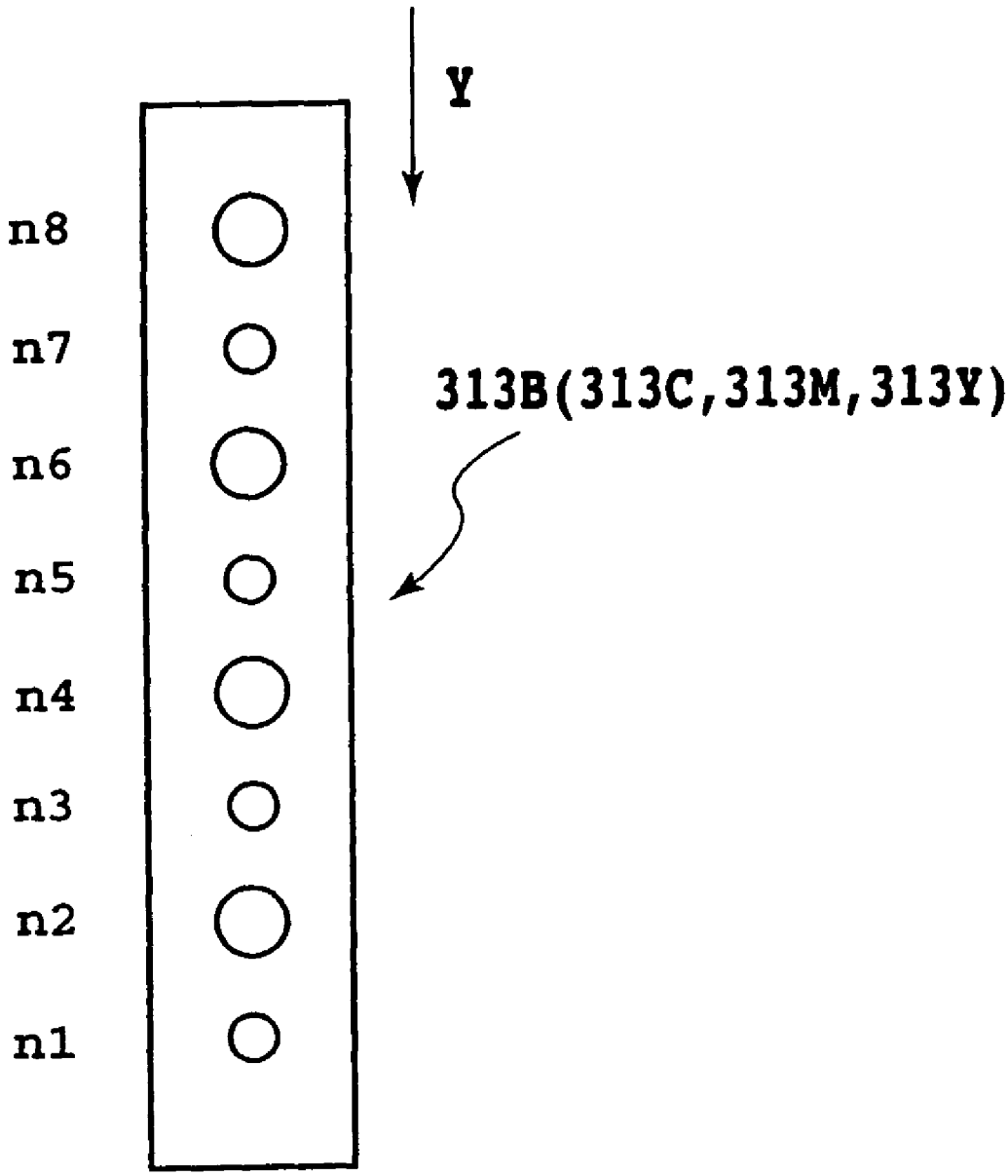
FIG. 4 is a configuration diagram of a printing head used in a first embodiment of the present invention.

FIG. 4 shows an ink ejection port forming surface of a printing head 313B representatively on which ink ejection ports are formed, the printing head 313B among printing heads 313B, 313C, 313M, and 313Y constituting a printing head unit 313 of the present embodiment.

Each of the printing heads 313B, 313C, 313M, and 313Y constituting the printing head unit 313 has eight (n) ejection ports (also referred to as "eight nozzles") for ejecting a color ink in a density of 1200 (N) dots per inch or 1200 dpi in a sub-scanning direction (the direction indicated by the arrow Y) that is orthogonal to a main scanning direction. The nozzles are assigned nozzle numbers n1 to n8, respectively, as illustrated. The nozzles having odd numbers such as n1 and n3 constitute a group of small apertures having a small ejection port diameter, and the nozzles having even numbers such as n2 and n4 constitute a group of large apertures having a large ejection port diameter. The size of ink droplets ejected from the group of small apertures is 2 (pl), and the size of ink droplets ejected from the group of large apertures is 5 (pl). In each of the printing heads 313B, 313C, 313M, and 313Y, one heater is provided in association with each of regions which are in communication with the ink ejection ports constituting the group of small apertures and the ink ejection ports constituting the group of large apertures.

A description will now be made on pixel patterns which are combinations of ink droplets having different ink amounts.

Figure 5:
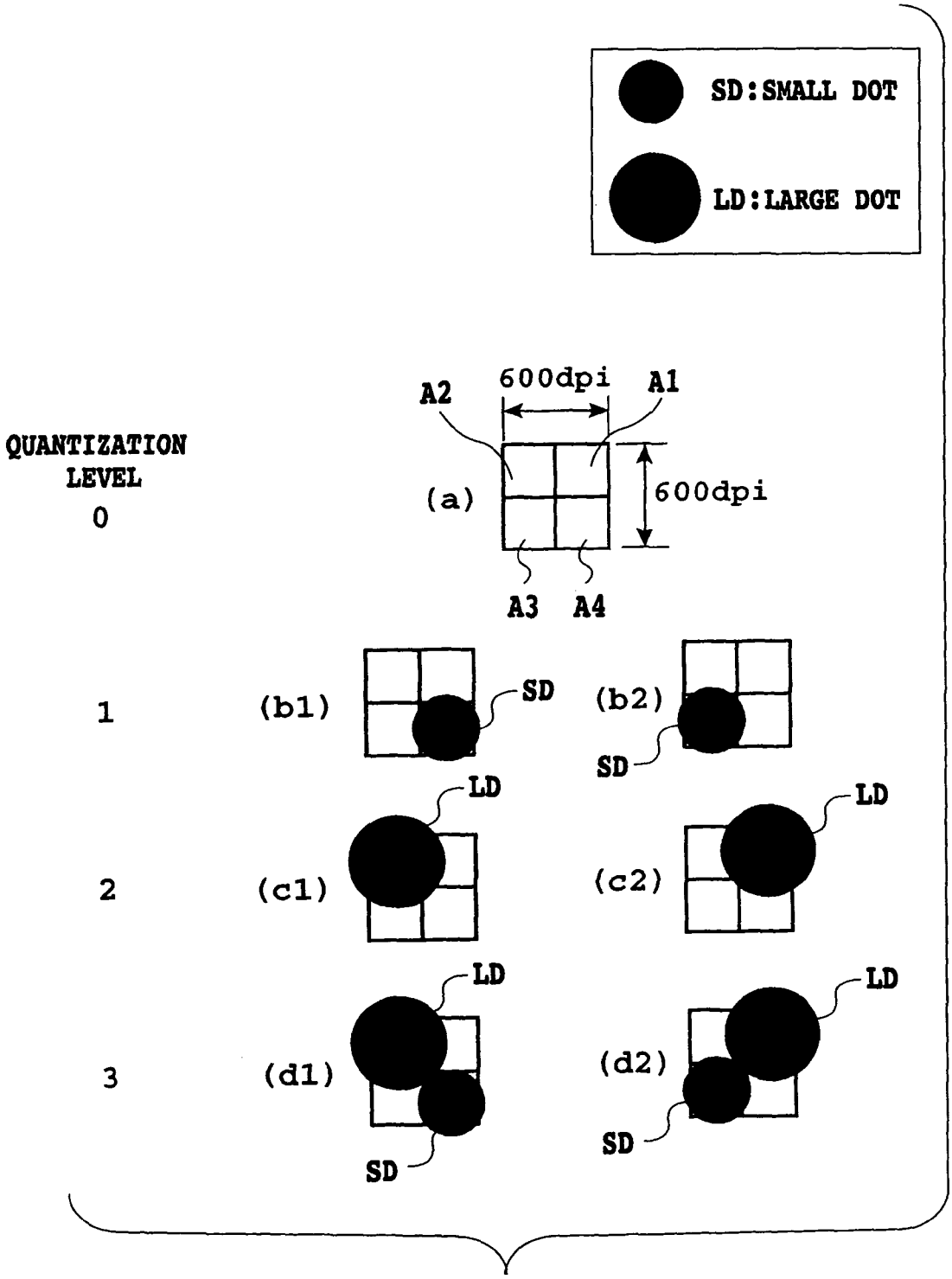
FIG. 5 is a view showing quantization levels of four-level and pixel patterns in the first embodiment of the present invention.

FIG. 5 is a view made available for explaining quantization levels of image data and pixel patterns in the present embodiment.

The term "quantization" means a multi-level processing, and "quantization levels" means the number of gradation, e.g., four-level, provided by the multi-level processing.

The quantization levels and pixel patterns are determined in advance according to the kind of image data to be recorded and the type of the printing medium.

Selection means may be further provided to allow a user to select an appropriate pattern from among a plurality of pixel patterns.

Examples of pixel patterns will now be described. In the present embodiment, pixel patterns (a), (b1), (b2), (c1), (c2), (d1), and (d2) are prepared for each pixel having a resolution of 600×600 dpi, the pixel patterns being constituted by two types of dots, i.e., a small dot SD and a large dot LD which are ink droplets of different sizes in a 2×2 matrix. Four levels of quantization, i.e., levels 0 to 3 are represented by using any of the pixel patterns, respectively. For example, each pixel is formed by areas A1, A2, A3, and A4 constituting minimum units for which it is defined whether to form a dot or not as shown in FIG. 5.

Input image data input from, for example, a host computer (not shown) has a multiplicity of gradation. In the present embodiment, the multi-gradation input image data is quantized into four levels. Specifically, as shown in FIG. 5, the level 0 is the pixel pattern (a) having no dot; the level 1 is the pixel pattern (b1) having only a small dot SD of 2 (pl) formed in the area A4 or the pixel pattern (b2) having only a small dot SD of 2 (pl) formed in the area A3; the level 2 is the pixel pattern (c1) having only a large dot LD of 5 (pl) formed in the area A2 or the pixel pattern (c2) having only a large dot LD of 5 (p1) formed in the area A1; the level 3 is the pixel pattern (d1) that is a combination of a small dot SD of 2 (pl) formed in the area A4 and a large dot LD of 5 (pl) formed in the area A2 or the pixel pattern (d2) that is a combination of a small dot SD of 2 (pl) formed in the area A3 and a large dot LD of 5 (pl) formed in the area A1.

Therefore, the multi-gradation input image data is converted into image data which is to be formed by those pixel patterns. Referring to the method of converting multi-gradation input image data into image data to be formed by pixel patterns, for example, the method disclosed in Japanese Patent Laid-Open No. No.9-46522(1997) may be employed.

Each of the pairs of pixel patterns (b1) and (b2), (c1) and (c2), and (d1) and (d2) is formed such that the areas (positions) where the large dot LD and the small dot SD are formed are symmetric with respect to a point each other.

In the present embodiment, there are four quantization levels, and pixel patterns as shown in FIG. 5 are set for each of the levels. However, this is not limiting the present invention, and quantization levels may be freely set according to, for example, the type of the printing medium used and the image data to be recorded. In order to increase the number of gradation, the quantization levels may be sub-divided, and the combinations of large and small dots may be changed.

Figure 6:
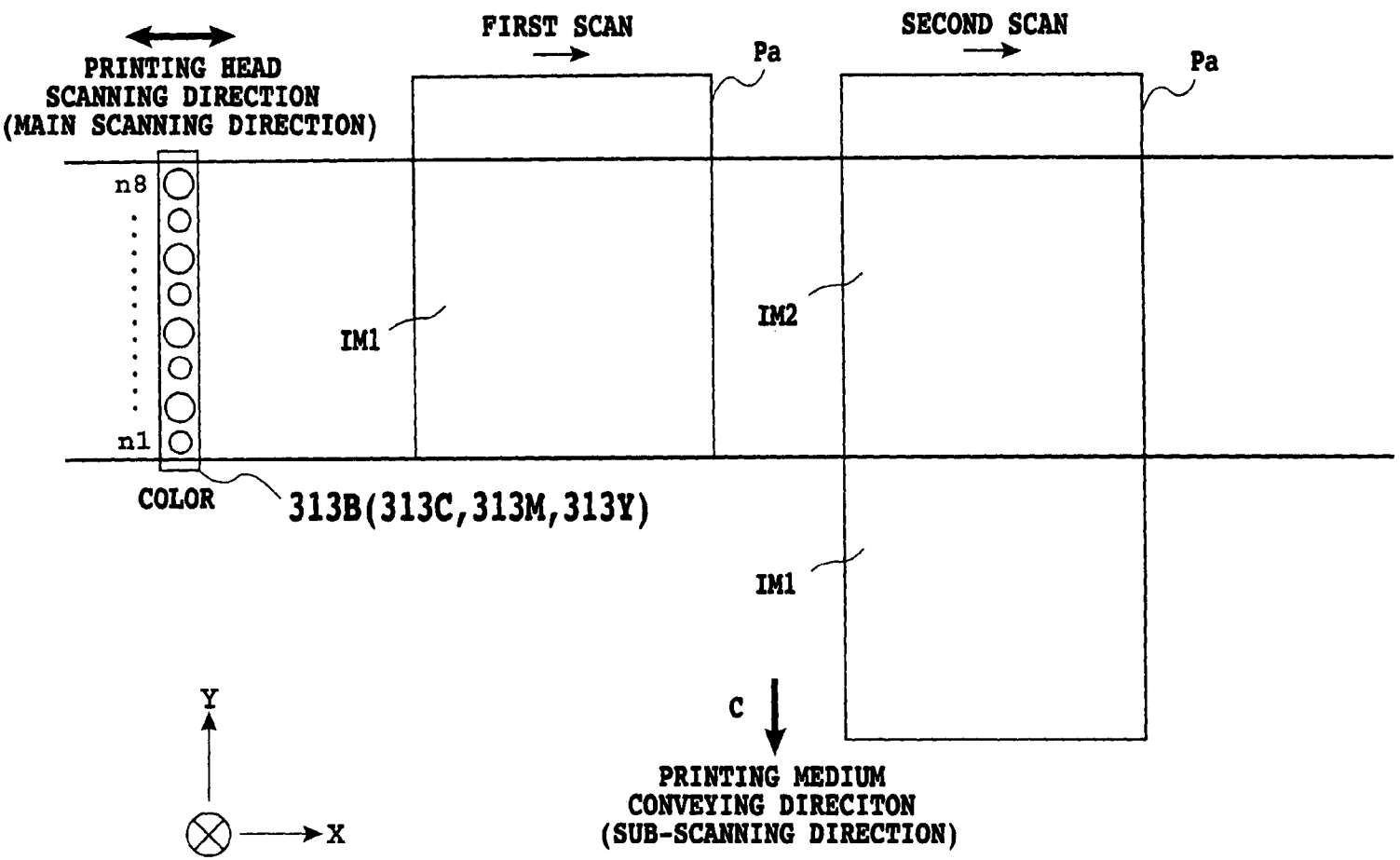
FIG. 6 is a schematic illustration of a printing operation in the first embodiment of the present invention.

FIG. 6 is a view made available for explaining how printing is performed by one scan of the printing heads 313B, 313C, 313M, and 313Y in the present embodiment. FIG. 6 shows one of the printing heads as a typical example.

In FIG. 6, printing is first performed in a first scan in an image area IM1 of a printing medium Pa in a forward direction indicated by the arrow X using all of the nozzles with the nozzle numbers n1 to n8, and an image is thereby completed in the image area IM1. Thereafter, the printing medium Pa is conveyed in the sub-scanning direction (the direction indicated by the arrow C) by a conveying amount of $^{8}/_{1200}$ inches which is equivalent to the combined width of all nozzles. Printing proceeds in the same manner as the first scan during second and subsequent scans for printing in the image area IM2.

Figure 7:
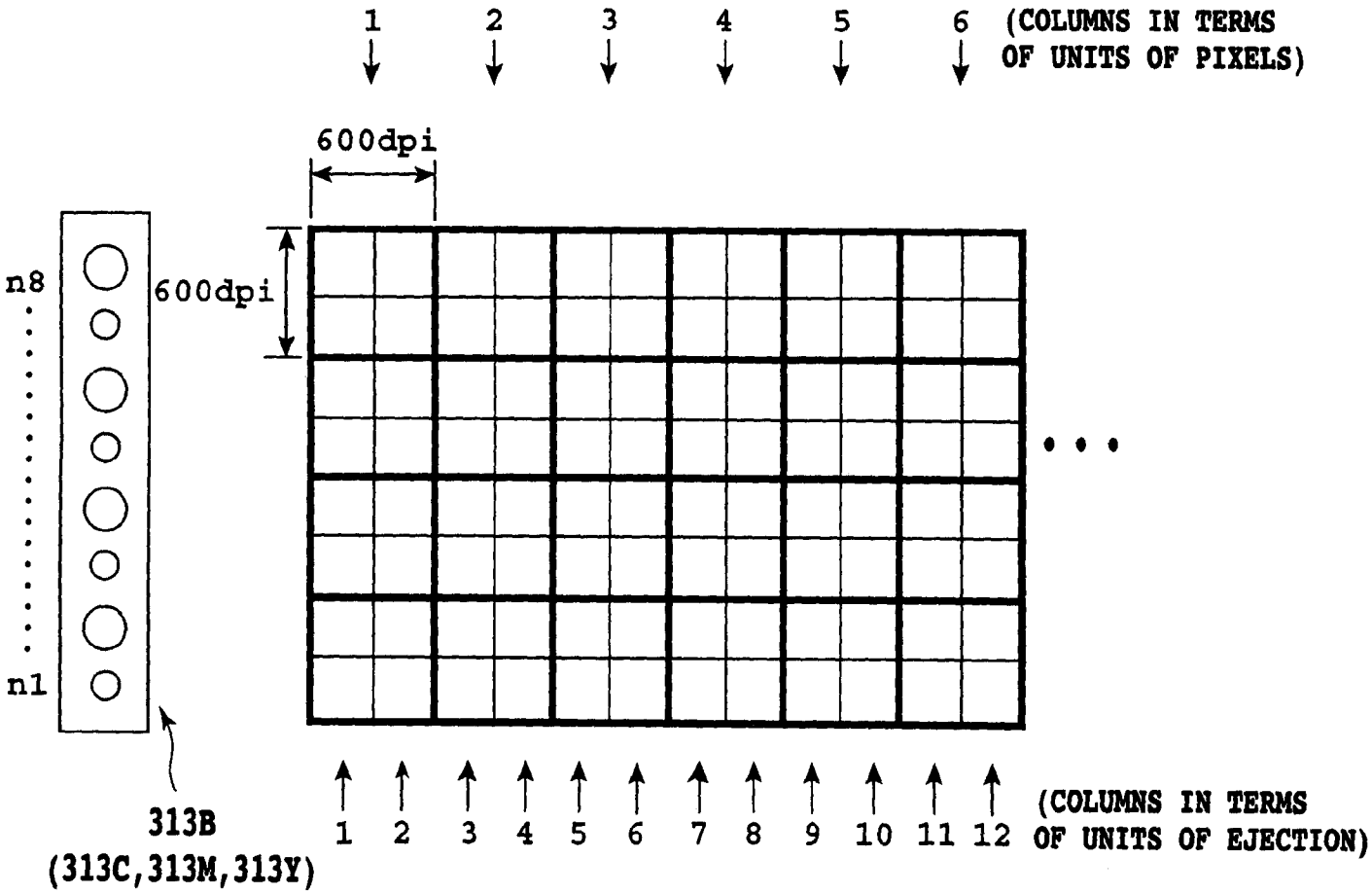
FIG. 7 is a schematic illustration of a printing method according to an arrangement of pixels in the first embodiment of the present invention.

FIG. 7 is a view made available for explaining an arrangement of pixels of image data comprising pixel patterns as shown in FIG. 5 to be printed by a printing operation as explained with reference to FIG. 6 according to the present embodiment.

In FIG. 7, image data associated with odd-numbered columns such as columns with column numbers 1, 3, and 5, each of which is assigned to a pixel (600 dpi) as a unit, are represented in four levels by using the pixel patterns (a), (b1), (c1), and (d1) among the pixel patterns (600×600 dpi) shown in FIG. 5. Image data associated with even-numbered columns such as columns with column numbers 2, 4, and 6, each of which is assigned to a unit of pixels (600 dpi), are represented in four levels by using the pixel patterns (a), (b2), (c2), and (d2) among the pixel patterns shown in FIG. 5. Let us now discuss the image data quantized in such a manner using column numbers each of which is assigned to a unit of ejection (1200 dpi). Then, all of the printing heads 313B, 313C, 313M, and 313Y eject only ink droplets to form large dots in the first column in terms of column numbers assigned to units of ejection (1200 dpi), the first column being included in the first column or an odd-numbered column in terms of column numbers assigned to units of pixels (600 dpi). All of the printing heads 313B, 313C, 313M, and 313Y eject only ink droplets to form small dots to print an image in the second column in terms of column numbers assigned to units of ejection (1200 dpi).

Next, all of the printing heads 313B, 313C, 313M, and 313Y eject only ink droplets to form small dots in the third column in terms of column numbers assigned to units of ejection, the third column being included in the second column or an even-numbered column in terms of column numbers assigned to units of pixels (600 dpi). They all eject only ink droplets to form large dots to print an image in the fourth column in terms of column numbers assigned to units of ejection (1200 dpi).

The operations for the first (odd-numbered) column and the second (even-numbered) column in terms of column numbers assigned to units of ejection are similarly performed in the third and subsequent columns in terms of column numbers assigned to units of pixels (600 dpi). Accordingly in terms of the units of ejection (1200 dpi), large dots (column number 1), small dots (column number 2), small dots (column number 3), and large dots (column number 4) are ejected in the order listed in the respective columns, and the process is repeated.

Accordingly, referring to a memory configuration for quantized image data, when each column (1200 dpi) in terms of units of ejection (1200 dpi) is printed during one main scan, the memory is used only for data associated with either groups of large dots from nozzles constituting large aperture groups of the printing heads 313B, 313C, 313M, and 313Y or groups of small dots from nozzles constituting small aperture groups of the printing heads. That is, at the same timing for ejection, ink is always ejected only from either the nozzles constituting the large aperture groups of the printing heads 313B, 313C, 313M, and 313Y or the nozzles constituting the small aperture groups of the printing heads. Therefore, ink will never be simultaneously ejected from the nozzles with a large aperture and the nozzles with a small aperture.

When data for each of the columns in terms of units of ejection (1200 dpi) is to be stored in a memory section of the RAM 302 and others, the data to be stored is only either data for the nozzles constituting the large aperture groups of the printing heads 313B, 313C, 313M, and 313Y or data for the nozzles constituting the small aperture groups of the recoding heads. Therefore, the memory section may be used to selectively store data for the nozzles constituting the large aperture groups, the nozzles constituting the small aperture groups, the nozzles constituting the small aperture groups, and the nozzles constituting the large aperture groups for each of the columns in terms of units of ejection (1200 dpi).

When algorithm is thus defined in advance for the use of the large aperture groups and the small aperture groups of the printing heads 313B, 313C, 313M, and 313Y, there is no need for distinguish data for the nozzles constituting the large aperture groups from data for the nozzles constituting the small aperture groups. As a result, it is possible to employ a configuration in which, for example, data for each of the columns in terms of units of ejection can be stored using a memory amount that is one half of a memory amount used as a print buffer according to the related art.

Since only either groups of large dots from the nozzles constituting the large aperture groups or groups of small dots from the nozzles constituting the small aperture groups are used to perform printing in each of the columns in terms of units of ejection (1200 dpi) during one and the same main scan, it is possible to employ a configuration in which power to drive the printing heads can be substantially halved from that in the related art.

Let us assume that printing heads ejecting ink droplets in different amounts, i.e., 5 (pl) and 2 (pl) and in different sizes are used for printing based on image data in which each pixel is quantized on a four-level as described above. Then, one printing scan is completed by repeating ejection of ink droplets of 5 (pl), 2 (pl), 2 (pl), and 5 (pl) per 1200 dpi in one and the same main scanning based on image data having four levels, i.e., 0 (pl), 2 (pl), 5 (pl), and 7 (pl) per 600×600 dpi.

Since the use of pixel patterns allows plural types of ink droplets in different sizes to be selectively used in one and the same main scan regardless of the arrangement of the ejection ports of the printing heads, a combination of pixel patterns optimal for the printing medium can be selected. It is therefore possible to prevent uneven density and to minimize the amount of memory used in the printing system and the amount of power to drive the printing heads of the same.

Referring to the configuration of the nozzles of the printing heads 313B, 313C, 313M, and 313Y, although the nozzles are in a row, this is not limiting the present invention. For example, a printing head may have a plurality of ink ejection ports which are configured as a plurality of rows of ejection ports and which can eject ink of one color in the form of plural types of ink droplets in different sizes.

According to the present embodiment, in the arrangement of pixels of image data comprising pixel patterns as shown in FIG. 5, image data associated with the odd-numbered columns in terms of column numbers assigned to units of pixels (600 dpi) is represented in four-level using four pixel patterns, i.e., pixel patterns (a), (b1), (c1), and (d1) for 600×600 dpi (see FIG. 5), and image data associated with the even-numbered columns in terms of column numbers assigned to units of pixels (600 dpi) is represented in four-level using four pixel patterns, i.e., pixel patterns (a), (b2), (c2), and (d2) for 600×600 dpi (see FIG. 5). However, this is not limiting the present invention.

For example, image data associated with the first, second, and third columns in terms of column numbers assigned to units of pixels (600 dpi) may be represented in four-level using four pixel patterns, i.e., pixel patterns (a), (b1), (c1), and (d1) for 600×600 dpi (see FIG. 5), and image data associated with the fourth, fifth, and sixth columns in terms of column numbers assigned to units of pixels (600 dpi) may be represented in four-level using four pixel patterns, i.e., pixel patterns (a), (b2), (c2), and (d2) for 600×600 dpi. Referring to dots in the columns in terms of units of ejection (1200 dpi) in this case, large dots are printed in the first column and are sequentially followed by small dots, large dots, small dots, large dots, small dots, small dots, large dots, small dots, large dots, small dots, and large dots, and the sequence is repeated. An optimum combination of the pixel patterns may be used in accordance with the printing medium used and image quality to be achieved.

The quantization levels may be freely changed in accordance with the printing medium used and image quality to be achieved. For example, in the case of image data for which the speed of printing is important and image quality is not so important, the quantization levels are reduced to two-level such that only the pixel patterns (a) and the pixel pattern (c1) or (c2) will be used among the pixel patterns shown in FIG. 5. Therefore, only ink droplets for large dots will be used for printing to perform high speed printing. Alternatively, each mode to allow selective use of any of the pixel patterns may be stored as a printing mode, and a user may be allowed to select such printing modes freely.

For example, a first printing mode may be a mode to allow use of all of the pixel patterns (a), (b1), (c1), (d1), (b2), (c2), and (d2) as shown in FIG. 5, and a second printing mode may be a mode to allow use of the pixel patterns consisting of a large dot only. Then, a user may appropriately use the first and second printing modes depending on the purpose.

As described above, in the present embodiment, pixel patterns are provided, each pixel pattern being a combination of a large dot and a small dot to be placed in one unit of pixels, and image data is processed using such pixel patterns to allow plural types of ink droplets in different sizes to be selectively used for printing in one and the same main scan. Therefore, an optimum combination of pixel patterns can be freely selected by changing pixel patterns according to the printing medium used and image quality to be achieved. Since an optimum combination of pixel patterns is selected by changing pixel patterns according to the printing medium used and the type of the image data, an uniform image having no uneven density can be obtained. Further, since a limit is placed on the size of ink droplets in each column constituting a unit of ejection as shown in FIG. 7 in pixel arrangement of the image data, the mount of memory used in the memory section of the printing system and the amount of power to drive the printing heads can be minimized to provide the printing apparatus at a low cost and in a small size.

Second Embodiment

The present embodiment is an example employing a plurality of printing heads 313B', 313C', 313M', and 313Y', each of the printing heads 313B', 313C', 313M', and 313Y' providing ink in a different color.

Further, an example will be described, in which an image in one image area is completed by a plurality of main scans of the printing heads 313B', 313C', 313M', and 313Y'.

Figure 8:
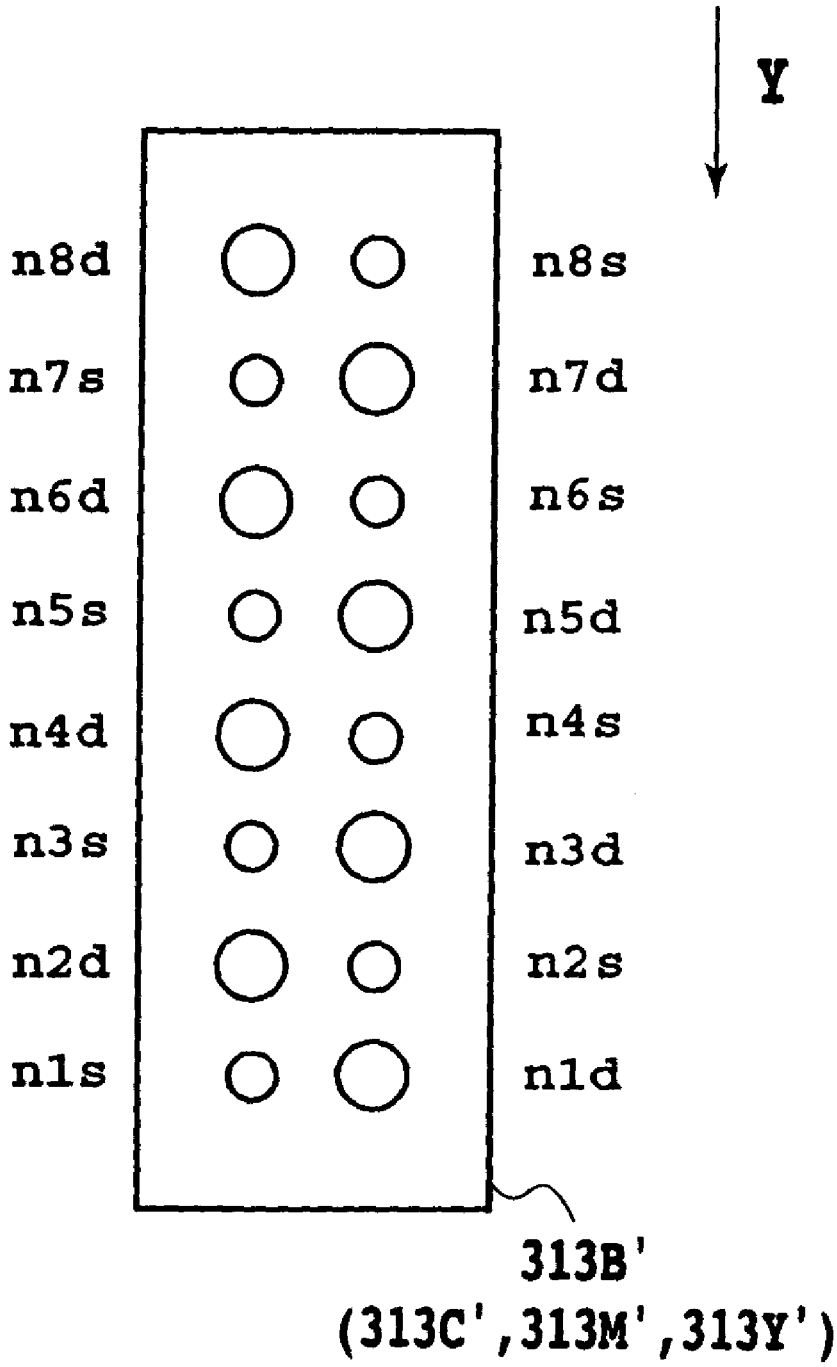
FIG. 8 is a configuration diagram of a printing head used in second, third, and fourth embodiments of the present invention.

FIG. 8 shows an ink ejection port forming surface of a printing head 313B' of the present embodiment. In FIG. 8, the surface of the printing head 313B' on which ink ejection port is provided is shown as a typical example of the plurality of printing heads 313B', 313C', 313M', and 313Y'.

The printing heads 313B', 313C', 313M', and 313Y' eject ink in four colors, i.e., black, cyan, magenta, and yellow, respectively. The printing head 313B' used in the present embodiment has two substantially parallel rows of ejection ports each consisting of eight ejection ports (eight nozzles) (n) for achieving a density of 600 (N) dots per inch (600 dpi) in a sub-scanning direction (the direction indicated by the arrow Y) that is orthogonal to a main scanning direction. Therefore, the printing head 313B' has sixteen ejection ports (sixteen nozzles) in total. Each of the rows of ink ejection ports of the printing head 313B' is constituted by two groups of ink ejection ports of different types. The nozzle numbers n1*s*, n2*s*, n3*s*, n4*s*, n5*s*, n6*s* n7*s*, and n8*s* shown in FIG. 8 represent a group of ink ejection ports having a small aperture. The nozzle numbers n1*d*, n2*d*, n3*d*, n4*d*, n5*d*, n6*d*, n7*d*, and n8*d* represent a group of ink ejection ports having a large aperture.

Just as described in the first embodiment, the size of ink droplets ejected from the group of small apertures is 2 (pl), and the size of ink droplets ejected from the group of large apertures is 5 (pl). One heater for ejecting ink is provided in association with each of regions which are in communication with the ink ejection ports constituting the group of small apertures and the ink ejection ports constituting the group of large apertures. A gap equivalent to the width (1200 dpi) of one unit of ejection is provided between the row of ejection ports on the left in the figure and the row of ejection ports on the right.

Figure 9:
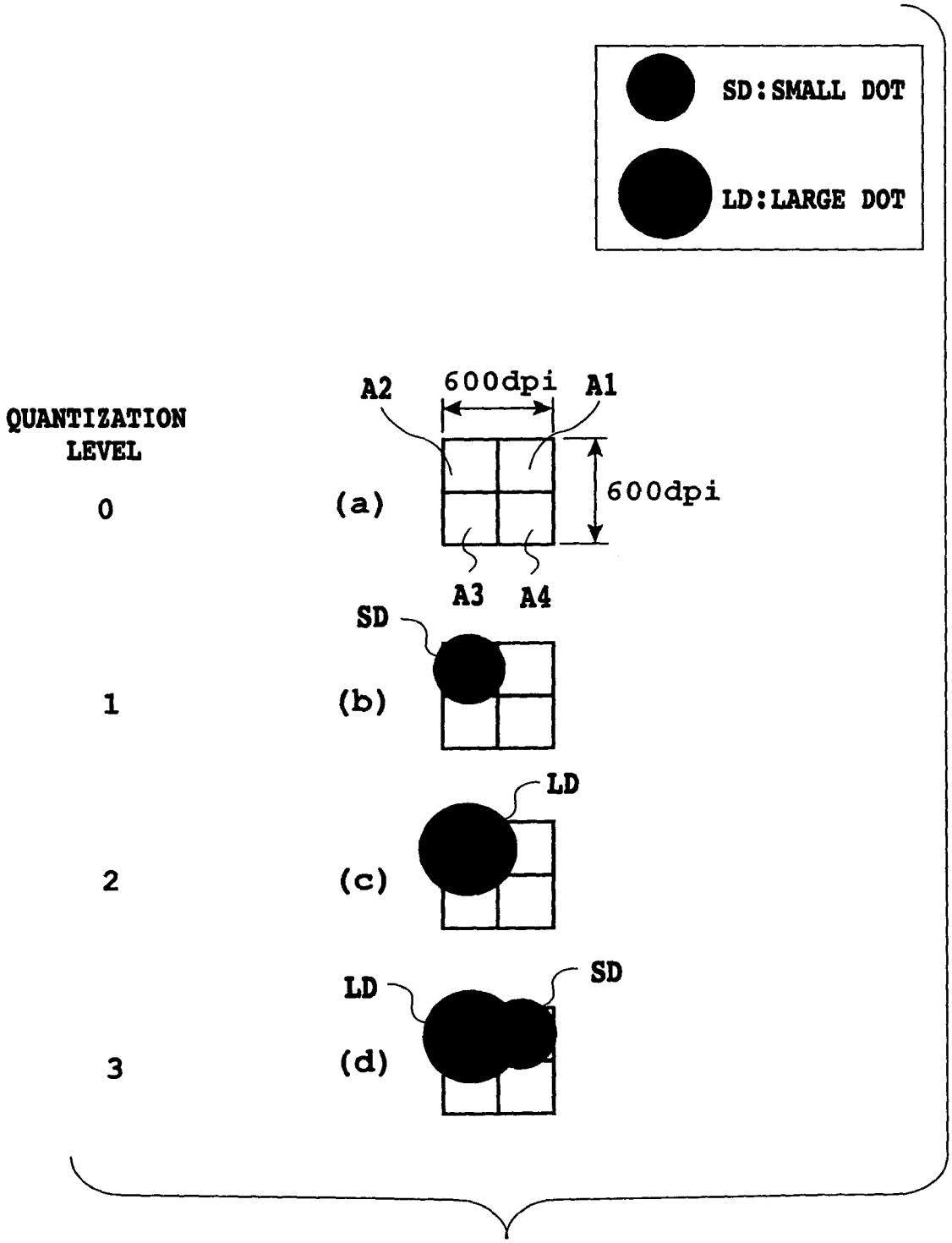
FIG. 9 shows quantization levels of four-level and pixel patterns in the second, third, and fourth embodiments of the present invention.

FIG. 9 is shown to explain quantization levels of image data and pixel patterns in the present embodiment. In the present embodiment, pixel patterns (a), (b), (c), and (d) are provided for each pixel having a resolution of 600×600 dpi, the pixel patterns being constituted by two types of dots, which are ink droplets of different sizes in a 2×2 matrix. Each pixel is formed by areas A1, A2, A3, and A4.

Four levels of quantization, i.e., levels 0 to 3, are represented using any of those pixel patterns. Input image data input from, for example, a host computer (not shown) have a multiplicity of tones. The input image data are quantized into four levels in order to allocate the pixel patterns to the data. The quantization level 0 is represented by the pixel pattern (a) which includes no dot; the level 1 is represented by the pixel pattern (b) which includes only a small dot SD of 2 (pl) formed in the area A2; the level 2 is represented by the pixel pattern (c) which includes only a large dot LD of 5 (pl) formed in the area A2; the level 3 is represented by the pixel pattern (d) that is a combination of a small dot SD of 2 (pl) formed in the area Al and a large dot LD of 5 (pl) formed in the area A2. Therefore, the input image data are converted into image data which are to be formed by those pixel patterns.

Figure 10:
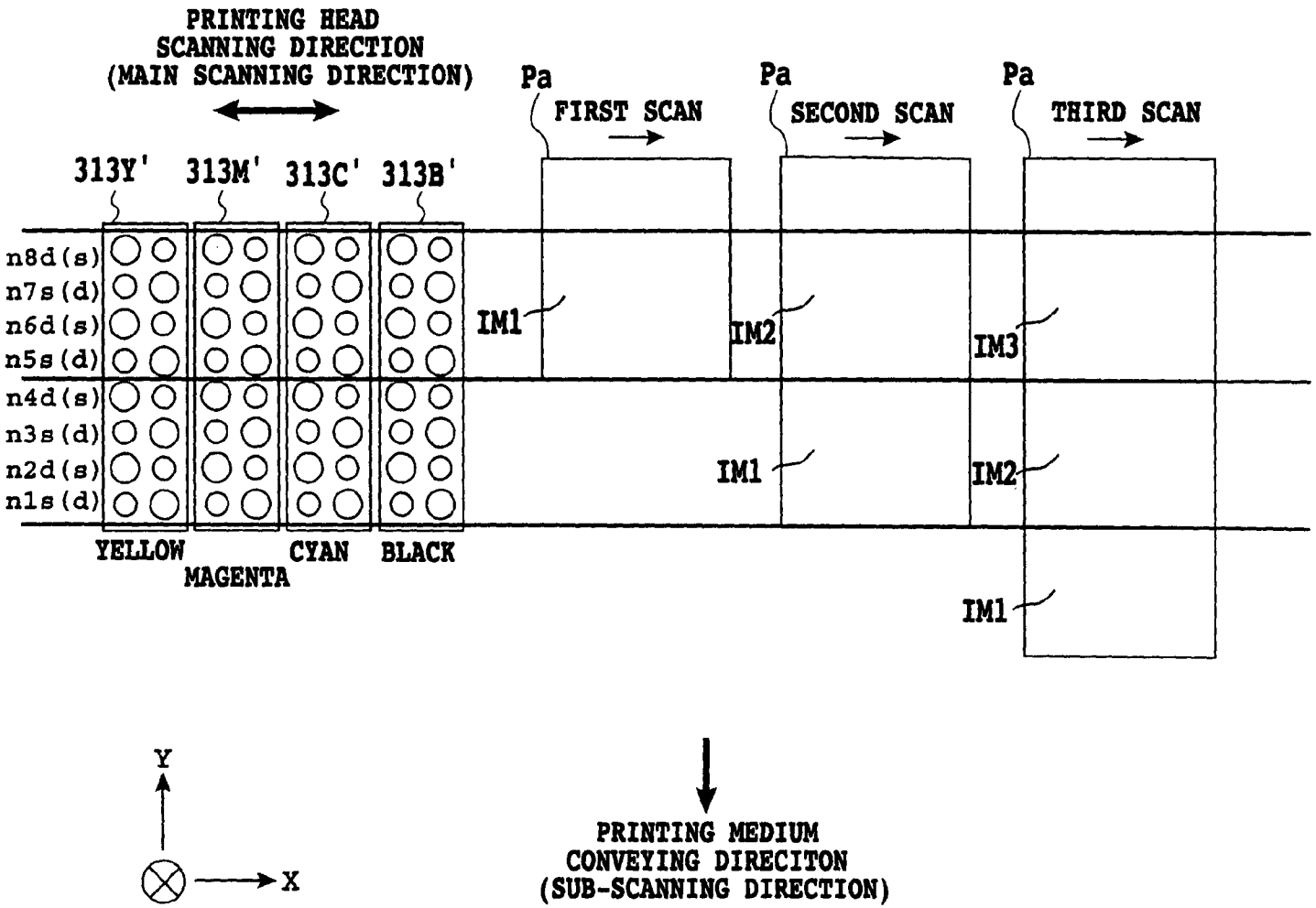
FIG. 10 is a schematic illustration of a printing operation in the second embodiment of the present invention.

FIG. 10 is shown to explain the printing heads 313B', 313C', 313M', and 313Y' and how printing is performed in one image area of a printing medium Pa by two scans according to the present embodiment.

Referring to FIG. 10, the printing medium Pa is conveyed in the sub-scanning direction by a conveying amount of 4/600 inches which is equivalent to one half of the combined width of all nozzles during a first scan. Then, printing is performed in an image area IM1 of the printing medium Pa in a forward direction based on the image data having pixel patterns as shown in FIG. 9 using the group of ink ejection ports of the small aperture having the nozzle numbers n5*s*, n6*s*, n7*s*, and n8*s* and the group of ink ejection ports of the large aperture having the nozzle numbers n5*d*, n6*d*, n7*d*, and n8*d* of each printing head.

When the first scan is completed, the printing medium Pa is conveyed in the sub-scanning direction by a conveying amount of 4/600 inches to perform a second scan of the printing. Printing is then performed in the moved image area IM1 based on the image data having pixel patterns as shown in FIG. 9 just as done in the first scan using the group of ink ejection ports of the small aperture having the nozzle numbers n1*s*, n2*s*, n3*s*, and n4*s* and the group of ink ejection ports of the large aperture having the nozzle numbers n1*d*, n2*d*, n3*d*, and n4*d*. In an image area IM2 that follows the image area IM1, printing is performed using the group of ink ejection ports of the small aperture having the nozzle numbers n5*s*, n6*s*, n7*s*, and n8*s* and the group of ink ejection ports of the large aperture having the nozzle numbers n5*d*, n6*d*, n7*d*, and n8*d* just as done in the first scan.

Printing is performed during third and subsequent scans in the same manner as in the second scan. That is, one image area is scanned twice using two different groups of ink ejection ports.

Figure 11:
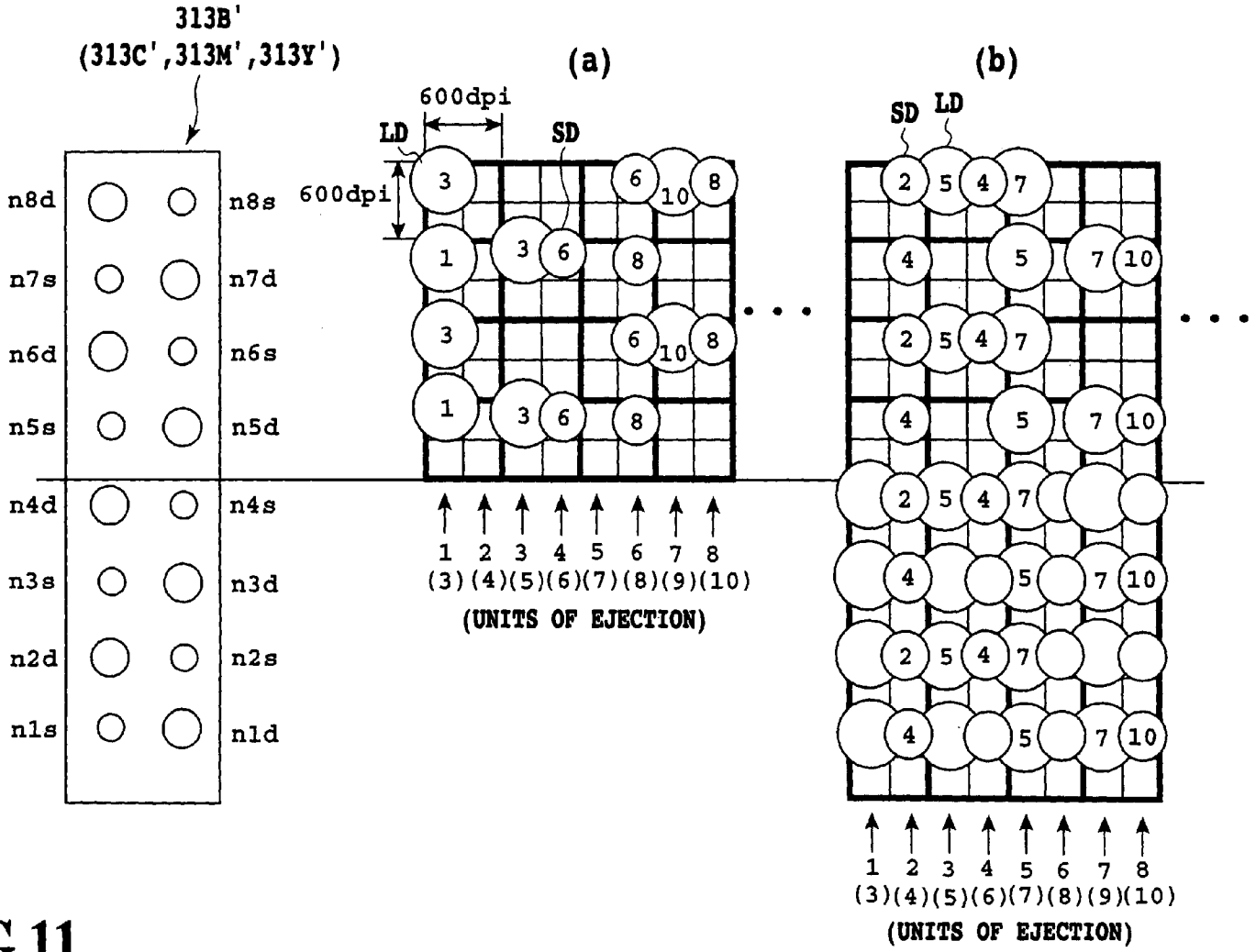
FIG. 11 is a schematic illustration of a printing method according to an arrangement of pixels in the second embodiment of the present invention.

(a) and (b) of FIG. 11 are shown to explain an arrangement of pixels of image data, comprising pixel patterns as shown in FIG. 9, to be recorded by a printing operation as explained with reference to FIG. 10 according to the present embodiment.

The numbers shown in (a) and (b) of FIG. 11 as units of ejection indicate column numbers in terms of the number of ink ejections. In other words, the first ejecting position that the printing heads 313B', 313C', 313M', and 313Y' reach after starting from a predetermined position constitutes a unit of ejection "1". The numbers without parentheses indicate positions for ejection from the ink ejection ports in the right row of the printing heads as shown in FIG. 11(*a*), and the numbers in parentheses indicate positions for ejection from the ink ejection ports in the left row. Since the left row of ejection ports reaches the first ejecting position when the right row of ejection ports form the unit of ejection "3", the left row starts with the unit of ejection "3". It is assumed here that each pixel of the image data is a solid image whose quantization level is the "level 3".

A description will now be made with reference to FIG. 11(*a*) on an arrangement of pixels of the image data in the image area IM1 recorded during the first scan as shown in FIG. 10.

When the right rows of ejection ports of the printing heads 313B', 313C', 313M', and 313Y' reach the first column in terms of units of ejection (1200 dpi) as a result of a movement of the heads, large dots LD are ejected from the ejection ports having nozzle numbers n5*d* and n7*d* in the right row. For the second column, since no small dot SD is located below and to the right of a large dot LD in FIG. 9, the nozzles numbered n8*s* and n6*s* are not applicable, and no ejection therefore takes place. For the third column, large dots LD are ejected from the ejection ports having nozzle numbers n5*d* and n7*d* in the right row of ejection ports and the ejection ports having nozzle numbers n6*d* and n8*d* in the left row of ejection ports. No ejection takes place for the fourth and fifth columns. For the sixth column, small dots SD are ejected from the ejection ports having nozzle numbers n6*s* and n8*s* in the right row of ejection ports and the ejection ports having nozzle numbers n5*s* and n7*s* in the left row of ejection ports. No ejection takes place for the seventh column. For the eighth column, small dots SD are ejected from the ejection ports having nozzle numbers n6*s* and n8*s* in the right row of ejection ports and the ejection ports having nozzle numbers n5*s* and n7*s* in the left row of ejection ports. No ejection takes place for the ninth column. An image is thus recorded. The printing operation proceeds for the tenth and subsequent columns by repeating a sequence of ejections to form large dots, no dot, large dots, no dot, no dot, small dots, no dot, small dots, and then no dot in respective columns in terms of units of ejection (1200 dpi), similar to the ejections for the first to ninth columns.

A description will now be made with reference to FIG. 11(*b*) on an arrangement of pixels of the image data in the image areas IM1 and IM2 recorded during the second scan as shown in FIG. 10. Referring to FIG. 11(*b*), no ejection takes place for the first column in terms of units of ejection (1200 dpi). For the second column, small dots SD are ejected from the ejection ports having nozzle numbers n2*s*, n4*s*, n6*s*, and n8*s* in the right row of ejection ports. No ejection takes place for the third column. For the fourth column, small dots SD are ejected from the ejection ports having nozzle numbers n2*s*, n4*s*, n6*s*, and n8*s* in the right row of ejection ports, and small dots SD are ejected from the ejection ports having nozzle numbers n1*s*, n3*s*, n5*s*, and n7*s* in the left row of ejection ports. For the fifth columns, large dots LD are ejected from the ejection ports having nozzle Nos. n1*d*, n3*d*, n5*d*, and n7*d* in the right row of ejection ports, and large dots LD are ejected from the ejection ports having nozzle Nos. n2*d*, n4*d*, n6*d*, and n8*d* in the left row of ejection ports. No ejection takes place for the sixth column. For the seventh column, large dots LD are ejected from the ejection ports having nozzle Nos. n1*d*, n3*d*, n5*d* and n7*d* in the right row of ejection ports and the ejection ports having nozzle Nos. n2*d*, n4*d*, n6*d* and n8*d* in the left row of ejection ports. No ejection takes place for the eighth and ninth columns.

An image is thus recorded. The printing operation proceeds for the tenth and subsequent columns by repeating a sequence of ejections to form no dot, small dots, no dot, small dots, large dot, no dot, large dots, no dot, no dot, and then no dot in respective columns in terms of units of ejection (1200 dpi), similar to the ejections for the first to ninth columns.

That is, the printing operation of the printing heads involves formation of any of large dots, small dots, and no dot in each column, and ejection of a large dot and ejection of a small dot will never take place concurrently for the same column number.

Printing is performed during the third and subsequent scans in the same manner as in the first and second scans.

Therefore, just as in the first embodiment, printing of each column in terms of units of ejection (1200 dpi) during one main scan involves only any one of ejection of large dots from the group of large apertures of the row of ejection ports, ejection of small dots from the group of small apertures, and ejection of no ink. Thus, there is no need for distinguish data for the group of large apertures from data for the group of small apertures in a memory configuration for the image data. Further, the memory capacity may be reduced by the amount of data to be otherwise reserved for columns for which no ejection takes place. Therefore, for example, when 8 bits are required as shown in FIG. 11(*a*) to store all data for each column in terms of units of ejection according to the related art, a 4-bit configuration may be employed according to the present embodiment. That is, it is possible to employ a configuration in which the amount of a memory to be used as a print buffer can be one half of that in the related art or less.

Since only either large dots from the group of large apertures or small dots from the group of small apertures are used for each column in terms of units of ejection (1200 dpi) to perform printing during one main scan, it is possible to employ a configuration in which the power to drive the heads can be substantially halved from that in the related art.

Further, all of the four printing heads, i.e., the printing head 313B' ejecting black ink, the printing head 313C' for ejecting cyan ink, the printing head 313M' for ejecting magenta ink, and the printing head 313Y' for ejecting yellow ink may be used for printing in the combination and sequence of large dots, small dots, and no ejection as shown in (a) and (b) of FIG. 11.

Such an example is not limiting the invention and, for example, two of the printing heads of two colors may be driven in the combination and sequence for the second scan shown in FIG. 11(*a*) to cause ejection at the non-ejecting timing of the first scan in the present embodiment.

Conversely, the combination and sequence for the first scan in FIG. 11(*a*) may be used for the first scan of the present embodiment to cause ejection at the non-ejection timing in the second scan. The maximum power consumption can be halved by driving those heads using a combination and sequence different from those for other colors.

Although four levels are represented by the pixel patterns in FIG. 9 in the present embodiment, the invention is not limited to the same. The invention is not limited to the printing operation illustrated in FIG. 10 and the above-described combinations and sequences for ejecting ink droplets in arrangements of pixels of image data different from that shown in FIG. 11(*a*). The number of quantization, pixel patterns, the number of printing scans to complete an image, and the combination and sequence of ejections of different ink droplets may be optimized depending on the printing medium used and image quality to be achieved.

When the second printing mode utilizing only large dots for representing two levels using the pixel patterns (a) and (c) shown in FIG. 9 is also employed depending on the printing medium used and image quality to be achieved, printing may be performed at a high speed using the second printing mode utilizing only large dots.

In the present embodiment, as described above, plural types of ink droplets in different sizes are selectively used for printing in one main scan utilizing pixel patterns to complete printing of one image area by repeating the main scan a plurality of times. As a result, even when a plurality of printing heads are employed for respective different ink colors, an optimum combination of pixel patterns can be selected depending on the printing medium used and image quality to be achieved. It is therefore possible to obtain a uniform image without density irregularities. Further, since the amount of use of a memory of a printing system and the amount of power to drive heads can be minimized, the printing apparatus can be provided at a low cost and in a small size.

Third Embodiment

A third embodiment of the invention will now be described. The following description will omit parts having like counterparts in the first and second embodiments to avoid duplication of description and will focus on parts that are characteristic of the present embodiment.

In the present embodiment, a description will be made on an example of a multi-pass printing method in which image data is thinned using a printing mask and in which an image is completed by scanning one image area of a printing medium Pa a plurality of times.

Printing heads in the present embodiment are the same as those shown in FIG. 8 and used in the second embodiment, quantized pixel patterns in the present embodiment are the same as those shown in FIG. 9 and used in the second embodiment.

FIGS. 12A to 12D show mask patterns of a printing mask used in the present embodiment. The present embodiment employs mask patterns which are associated with areas each consisting of 8×2 dot printing positions (grids of 600 dpi in the vertical direction by 1200 dpi in the horizontal direction). In each of mask patterns MA, MB, MC, and MD, black parts are parts where output is provided. Printing is performed in 25% of each of the four types of mask patterns, and the mask patterns are in a complementary relationship with each other. Therefore, printing based on predetermined image data is performed 100% through four scans.

In the present embodiment, the whole image area of interest originates from image data of the quantization level 3.

Figure 13:
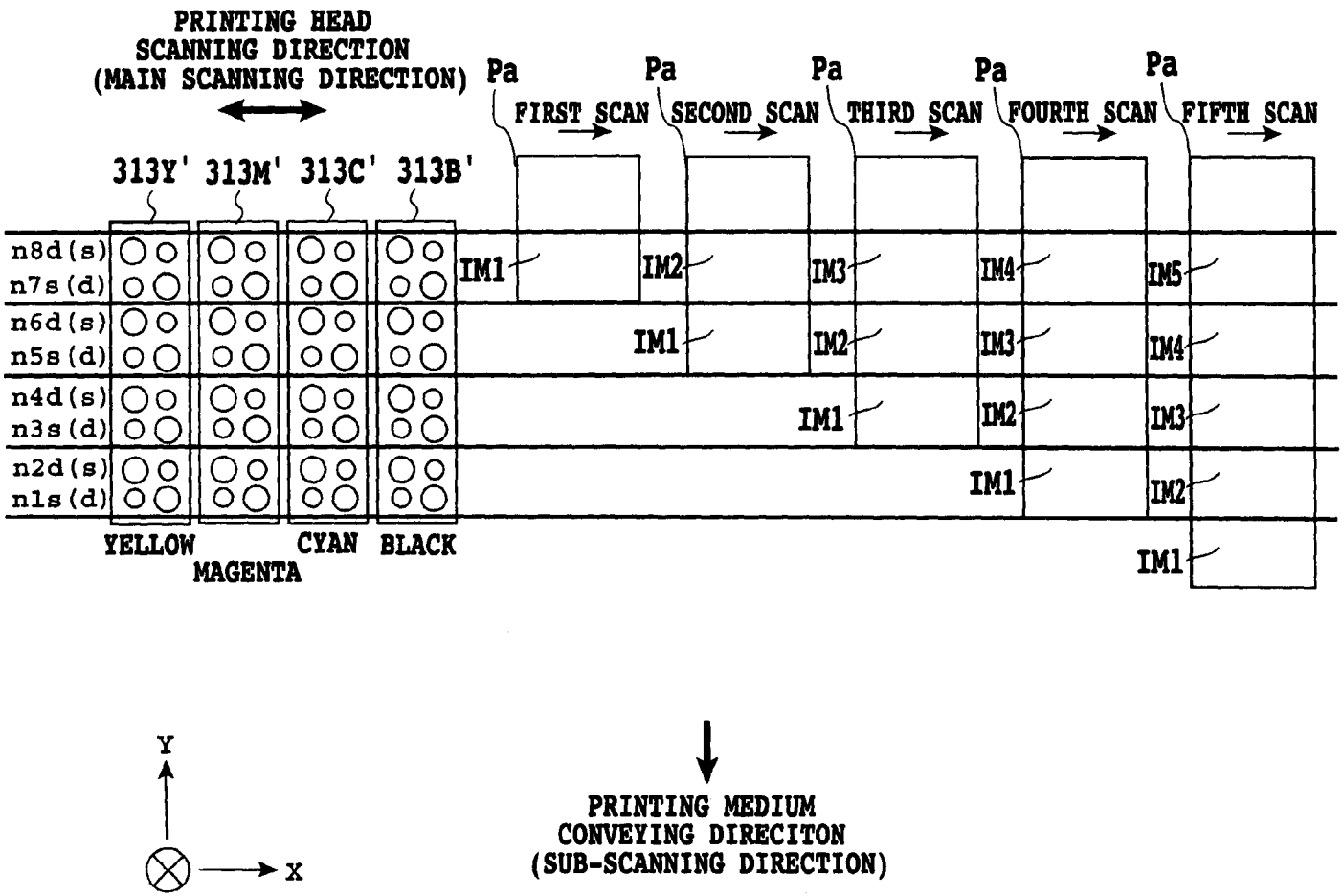
FIG. 13 is a schematic illustration of a printing operation in the third embodiment of the present invention.

FIG. 13 is shown to explain printing heads in the present embodiment and how one image area is recorded by four scan using the four types of printing masks.

Referring to FIG. 13, a printing medium Pa is conveyed in the sub-scanning direction by a conveying amount of 2/600 inches which is equivalent to one-fourth of the combined width of all nozzles during a first scan. Then, printing is performed in an image area IM1 using a group of ink ejection ports of a small aperture having nozzle numbers n7*s* and n8*s* and a group of ink ejection ports of a large aperture having nozzle numbers n7*d* and n8*d* of each of printing heads 313B', 313C', 313M', and 313Y'. The ink ejection ports driven are determined according to a result of thinning of image data using the mask pattern MA shown in FIG. 12A, the image data having been quantized using the pixel patterns (a) to (d) shown in FIG. 9.

When the first scan is completed, the printing medium Pa is conveyed in the sub-scanning direction by a conveying amount of 2/600 inches to perform a second scan of the printing. The image data used has been thinned using the mask pattern MB in FIG. 12B. Printing is then performed in the image area IM1 in a forward direction using a group of ink ejection ports of a small aperture having nozzle numbers n5*s* and n6*s* and a group of ink ejection ports of a large aperture having nozzle numbers n5*d* and n6*d*. Printing is performed in an image area IM2 in the forward direction using the group of ink ejection ports of a small aperture having nozzle numbers n7*s* and n8*s* and the group of ink ejection ports of a large aperture having nozzle numbers n7*d* and n8*d*.

When the second scan is completed, the printing medium Pa is similarly conveyed in the sub-scanning direction by a conveying amount of 2/600 inches to perform a third scan of the printing. The image data used here has been thinned using the mask pattern MC in FIG. 12C. Printing is performed in the image area IM1 in the forward direction using a group of ink ejection ports of a small aperture having nozzle numbers n3*s* and n4*s* and a group of ink ejection ports of a large aperture having nozzle numbers n3*d* and n4*d*. Printing is performed in the image area IM2 in the forward direction using the group of ink ejection ports of a small aperture having nozzle numbers n5*s* and n6*s* and the group of ink ejection ports of a large aperture having nozzle numbers n5*d* and n6*d*. Printing is performed in an image area IM3 in the forward direction using the group of ink ejection ports of a small aperture having the nozzle numbers n7*s* and n8*s* and the group of ink ejection ports of a large aperture having the nozzle numbers n7*d* and n8*d*.

When the third scan is completed, the printing medium Pa is similarly conveyed in the sub-scanning direction by a conveying amount of 2/600 inches to perform a fourth scan of the printing. The image data used here has been thinned using the mask pattern MC in FIG. 12C. Printing is performed in the image area IM1 in the forward direction using a group of ink ejection ports of a small aperture having nozzle numbers n1*s* and n2*s* and a group of ink ejection ports of a large aperture having nozzle numbers n1*d* and n2*d*.

Printing is performed in the image area IM2 in the forward direction using the group of ink ejection ports of a small aperture having nozzle numbers n3*s* and n4*s* and the group of ink ejection ports of a large aperture having nozzle numbers n3*d* and n4*d*.

Printing is performed in the image area IM3 in the forward direction using the group of ink ejection ports of the small aperture having the nozzle numbers n5*s* and n6*s* and the group of ink ejection ports of a large aperture having the nozzle numbers n5*d* and n6*d*.

Printing is performed in an image area IM4 in the forward direction using the group of ink ejection ports of a small aperture having the nozzle numbers n7*s* and n8*s* and the group of ink ejection ports of a large aperture having the nozzle numbers n7*d* and n8*d*.

Printing is performed during a fifth and subsequent scans in the same manner as in the first through fourth scans.

Figure 14:
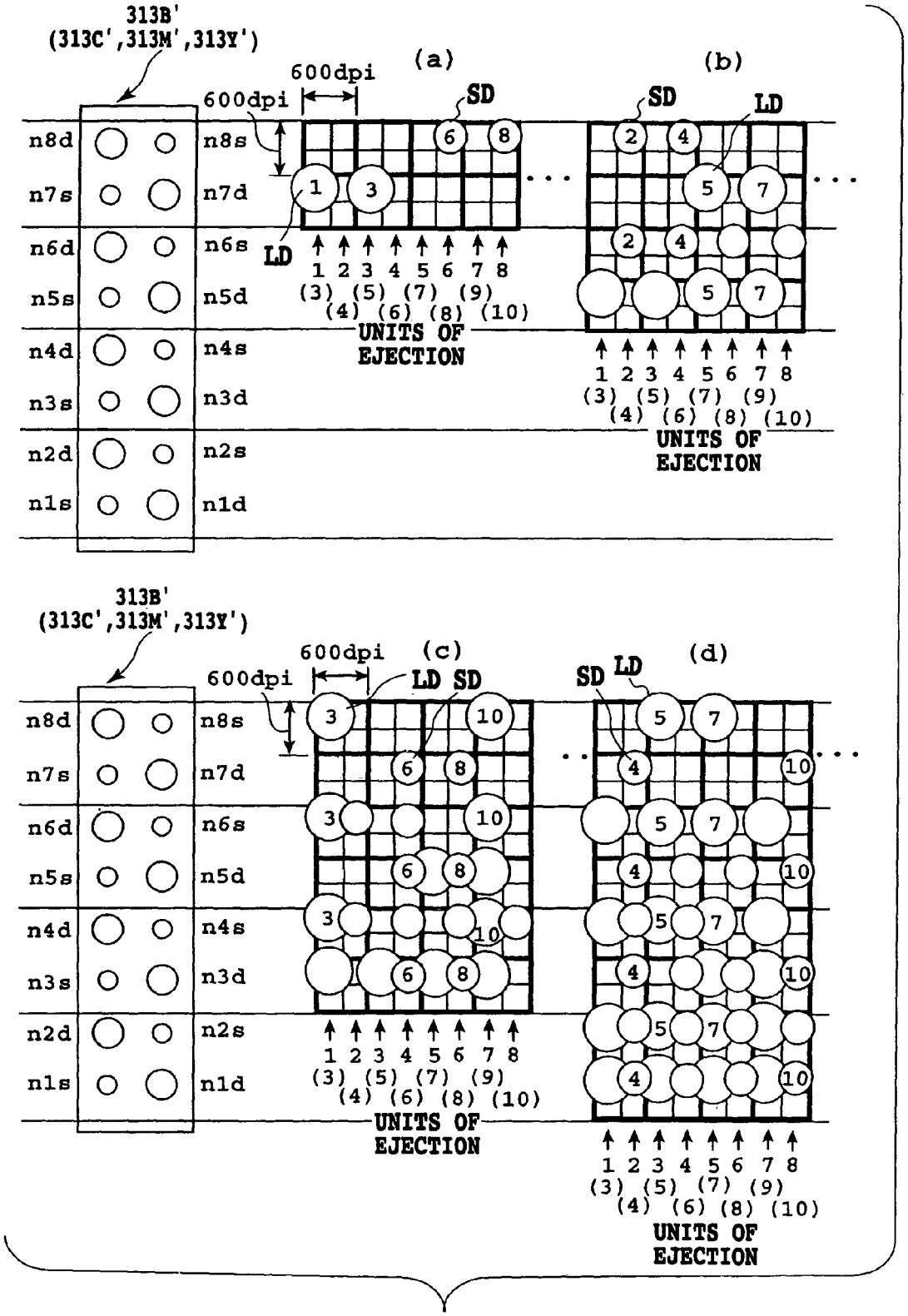
FIG. 14 is a schematic illustration of a printing method according to an arrangement of pixels in the third embodiment of the present invention.

FIG. 14 is shown to explain an arrangement of pixels of image data comprising pixel patterns (a) to (d) as shown in FIG. 9 to be recorded by a printing operation as explained with reference to FIG. 13 according to the present embodiment. The numbers of the unit of ejection shown in FIG. 14 indicate column numbers in terms of the ink ejecting positions. The numbers without parentheses indicate positions for ejection from ink ejection ports in right rows of the printing heads 313B', 313C', 313M.', and 313Y', and the numbers in parentheses indicate positions for ejection from the ink ejection ports in the left rows.

A description will now be made with reference to FIG. 14(*a*) on an arrangement of pixels of the image data in the image area IM1 recorded during the first scan as shown in FIG. 13. Printing is performed by controlling ejections such that a large dot LD is ejected for the first column in terms of units of ejection (1200 dpi) from the ejection port having the nozzle number n7*d* in the right row of ejection ports; no ejection takes place for the second column; large dots LD are ejected for the third column from the ejection port having the nozzle number n7*d* in the right row and the ejection port having the nozzle number n8*d* in the left row; no ejection takes place for the fourth and fifth columns; small dots SD are ejected for the sixth column from the ejection port having the nozzle number n8*s* in the right row and the ejection port having the nozzle number n7*s* in the left row; no ejection takes place for the seventh column; small dots SD are ejected for the eighth column from the ejection port having the nozzle number n8*s* in the right row and the ejection port having the nozzle number n7*d* in the left row; and no ejection takes place for the ninth column.

Figure 12A:
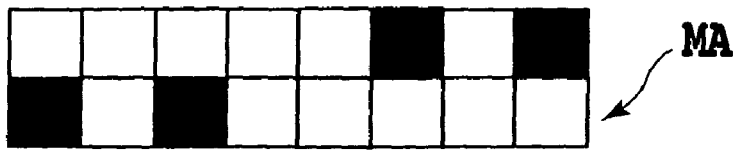
FIGS. 12A to 12D are schematic views of printing mask patterns used in the third embodiment of the present invention.

Printing is performed using the mask pattern MA shown in FIG. 12A based on the image data which comprises pixel patterns (a) to (d) as shown in FIG. 9 under control over ink ejection as thus described.

For the tenth and subsequent columns, an operation of repeating a sequence of ejections to form large dots, no dot, large dots, no dot, no dot, small dots, no dot, small dots, and then no dot in respective columns in terms of units of ejection (1200 dpi) is performed similarly to the ink ejecting operations for the first to ninth columns. Printing is performed using the mask pattern MA shown in FIG. 12A based on the image data which comprises pixel patterns (a) to (d) as shown in FIG. 9 under control over ink ejection as thus described.

A description will now be made with reference to FIG. 14(*b*) on an arrangement of pixels of the image data in the image area IM1 and an image area IM2 recorded during the second scan as shown in FIG. 13. Printing is performed by controlling ejections such that no ejection takes place for the first column in terms of units of ejection (1200 dpi); small dots SD are ejected for the second column from the ejection ports having the nozzle numbers n6*s* and n8*s*in the right row of ejection ports; no ejection takes place for the third column; small dots SD are ejected for the fourth column from the ejection ports having the nozzle numbers n6*s* and n8*s* in the right row and the ejection ports having the nozzle numbers n5*s* and n7*s* in the left row; large dots LD are ejected for the fifth column from the ejection ports having the nozzle numbers n5*d* and n7*d* in the right row and the ejection ports having the nozzle numbers n6*d* and n8*d* in the left row; no ejection takes place for the sixth column; large dots are ejected for the seventh column from the ejection ports having the nozzle numbers n5*d* and n7*d* in the right row and the ejection ports having the nozzle numbers n6*d* and n8*d* in the left row; and no ejection takes place for the eighth and ninth columns.

Figure 12B:
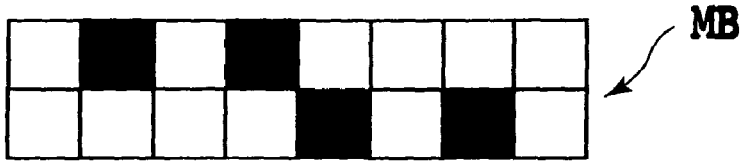

Printing is performed using the mask pattern MB shown in FIG. 12B based on the image data which comprises pixel patterns (a) to (d) as shown in FIG. 9 under control over ink ejection as thus described.

For the tenth and subsequent columns, an operation of repeating a sequence of ejections to form no dot, small dots, no dot, small dots, large dots, no dot, large dots, no dot, and then no dot in respective columns in terms of units of ejection (1200 dpi) is performed similarly to the ink ejecting operations for the first to ninth columns. Printing is performed using the mask pattern shown in FIG. 12A based on the image data which comprises pixel patterns (a) to (d) as shown in FIG. 9 under control over ink ejection as thus described.

A description will now be made with reference to FIG. 14(*c*) on an arrangement of pixels of the image data in the image area IM1, the image area IM2, and an image area IM3 recorded during the third scan as shown in FIG. 13. Printing is performed by controlling ejections such that large dots LD are ejected for the first column in terms of units of ejection (1200 dpi) from the ejection ports having the nozzle numbers n3*d*, n5*d*, and n7*d* in the right row of ejection ports; no ejection takes place for the second column; large dots are ejected for the third column from the ejection ports having the nozzle numbers n3*d*, n5*d*, and n7*d* in the right row and the ejection ports having the nozzle numbers n4*d*, n6*d*, and n8*d* in the left row; no ejection takes place for the fourth and fifth columns;

small dots SD are ejected for the sixth column from the ejection ports having the nozzle numbers n4*d*, n6*s*, and n8*s* in the right row and ejection ports having the nozzle numbers n3*d*, n5*s*, and n7*s* in the left row and the ejection ports having the nozzle numbers n5*s* and n7*s* in the left row; no ejection takes place for the seventh column; small dots are ejected for the eighth column from the ejection ports having the nozzle numbers n4*d*, n6*s*, and n8*s* in the right row and the ejection ports having the nozzle numbers n3*d*, n5*s*, and n7*s* in the left row; and no ejection takes place for the ninth column.

Printing is performed using the mask pattern MB shown in FIG. 12B based on the image data which comprises pixel patterns (a) to (d) as shown in FIG. 9 under control over ink ejection as thus described.

Figure 12C:
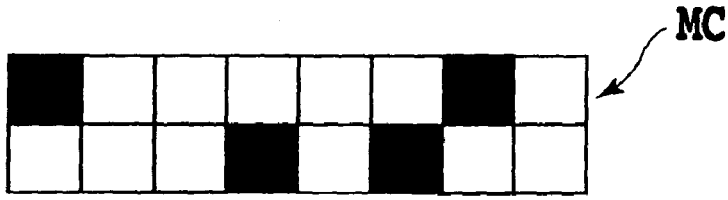

For the tenth and subsequent columns, an operation of repeating a sequence of ejections to form large dots, no dot, large dots, no dot, no dot, small dots, no dot, small dots, and then no dot in respective columns in terms of units of ejection (1200 dpi) is performed similarly to the ink ejecting operations for the first to ninth columns, the same printing operation being performed using the mask pattern MC shown in FIG. 12C based on the image data which comprises pixel patterns as shown in FIG. 9.

A description will now be made with reference to FIG. 14(*d*) on an arrangement of pixels of the image data in the image area IM1, the image area IM2, the image area IM3, and an image area IM4 recorded during the fourth scan as shown in FIG. 13. Printing is performed by controlling ejections such that no ejection takes place for the first column in terms of units of ejection (1200 dpi); small dots SD are ejected for the second column from the ejection ports having the nozzle numbers n2*s*, n4*s*, n6*s*, and n8*s* in the right row of ejection ports; no ejection takes place for the third column; small dots are ejected for the fourth column from the ejection ports having the nozzle numbers n2*s*, n4*s*, n6*s*, and n8*s* in the right row and the ejection ports having the nozzle numbers n1*s*, n3*s*, n5*s*, and n7*s* in the left row; large dots LD are ejected for the fifth column from the ejection ports having the nozzle numbers n1*d*, n3*d*, n5*d*, and n7*d* in the right row and the ejection ports having the nozzle numbers n2*d*, n4*d*, n6*d*, and n8*d* in the left row; no ejection takes place for the sixth columns; large dots are ejected for the seventh column from the ejection ports having the nozzle numbers n1*d*, n3*d*, n5*d*, and n7*d* in the right row and the ejection ports having the nozzle numbers n2*d*, n4*d*, n6*d*, and n8*d* in the left row; and no ejection 20 takes place for the eighth and ninth columns.

Figure 12D:
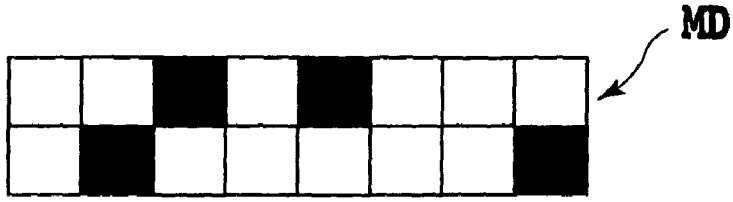

Printing is performed using the mask pattern MD shown in FIG. 12D based on the image data which comprises pixel patterns (a) to (d) as shown in FIG. 9 under control over ink ejection as thus described.

Referring to an ink ejecting operation for the tenth and subsequent columns, an operation of repeating a sequence of ejections to form no dot, small dots, no dot, small dots, large dots, no dot, large dots, no dot, and then no dot in respective columns in terms of units of ejection (1200 dpi) is performed similarly to the ink ejecting operations for the first to ninth columns.

Printing is performed using the mask pattern MD shown in FIG. 12D based on the image data which comprises pixel patterns as shown in FIG. 9 under control over ink ejection as thus described.

Printing is performed during fifth and subsequent scans in the same manner as in the first to fourth scans.

As a result of the use of such a method of printing, printing of a column in terms of units of ejection (1200 dpi) during one main scan involves only any one of ejection of large dots from the group of large apertures of the rows of ejection ports, ejection of small dots from the group of small apertures, and ejection of no ink, just as seen in the first and second embodiments. Thus, there is no need for distinguish data for the group of large apertures from data for the group of small apertures in a memory configuration for the image data. Further, the memory capacity may be reduced by the amount of data to be otherwise reserved for columns for which no ejection takes place. It is therefore possible to employ a configuration in which the amount of a memory to be used as a print buffer can be one half or less of that in the related art or less, as described above.

Since only either large dots from the group of large apertures or small dots from the group of small apertures are used for the same column number in terms of units of ejection (1200 dpi) to perform printing during one main scan, it is possible to employ a configuration in which the power to drive the heads can be substantially halved from that in the related art.

Further, all of the four printing heads, i.e., the printing head 313B' ejecting black ink, the printing head 313C' for ejecting cyan ink, the printing head 313M' for ejecting magenta ink, and the printing head 313Y' for ejecting yellow ink may be used for printing in the combination and sequence of large dots LD, small dots SD, and no ejection as shown in (a) to (d) of FIG. 14.

Such an example is not limiting the invention and, for example, the printing heads for the four respective colors may be scanned in different sequences, e.g., a sequence of scans according to (a), (b), (c), and then (d) of FIG. 14 for black, a sequence of scans according to (b), (c), (d), and then (a) of FIG. 14 for cyan, a sequence of scans according to (c), (d), (a), and then (b) of FIG. 14 for magenta, and a sequence of scans according to (b), (c), (d), and (a) of FIG. 14 for yellow.

A further reduction of the maximum power consumption may be achieved by employing a different combination and sequence for selection of different ink droplets and a different mask pattern to be used for printing by each of the printing heads ejecting inks in different colors during one main scan, as thus described.

Although four levels of quantization are represented by the pixel patterns in FIG. 9 in the present embodiment, the invention is not limited to the same. The invention is not limited to the printing operation described with reference to FIG. 13 and the above-described combinations and sequences for ejecting ink droplets in arrangements of pixels of image data different from that shown in (a) to (d) of FIG. 14. The number of quantization, pixel patterns, the number of printing scans to complete an image, and the combination and sequence of ejections of different ink droplets may be optimized depending on the printing medium used and image quality to be achieved.

When the second printing mode utilizing only large dots for representing two levels using the pixel patterns (a) and (c) shown in FIG. 9 is also employed depending on the printing medium used and image quality to be achieved, printing may be performed using the second printing mode utilizing only large dots in combination with the multi-pass printing method used in the present embodiment in which the printing mask patterns MA to MD shown in FIGS. 12A to 12D are used.

In the present embodiment, as described above, plural types of ink droplets in different sizes are selectively used for printing in one main scan utilizing pixel patterns, which allows the pixel patterns to be combined in an optimum way depending on the printing medium used and image quality to be achieved. Further, since an image in one image area can be completed through a plurality of main scans using image data which has been thinned using printing masks, a more uniform image without density irregularities can be obtained. Furthermore, since the amount of use of a memory of a printing system and the amount of power to drive heads can be minimized, the printing apparatus can be provided at a low cost and in a small size.

Fourth Embodiment

A fourth embodiment of the invention will now be described. The following description will omit parts having like counterparts in the first, second, and third embodiments to avoid duplication of description and will focus on parts that are characteristic of the present embodiment.

In the present embodiment, as in the second and third embodiments, printing heads ejecting ink droplets in different sizes similar to those shown in FIG. 8 are used for cyan, magenta, and yellow inks, and a printing head 400 ejecting only ink droplets in a certain size (see FIG. 15) is used for a black ink.

In the present embodiment, the quantized pixel patterns shown in FIG. 9 and used in the second and third embodiments are used for the cyan, magenta, and yellow inks.

Figure 15:
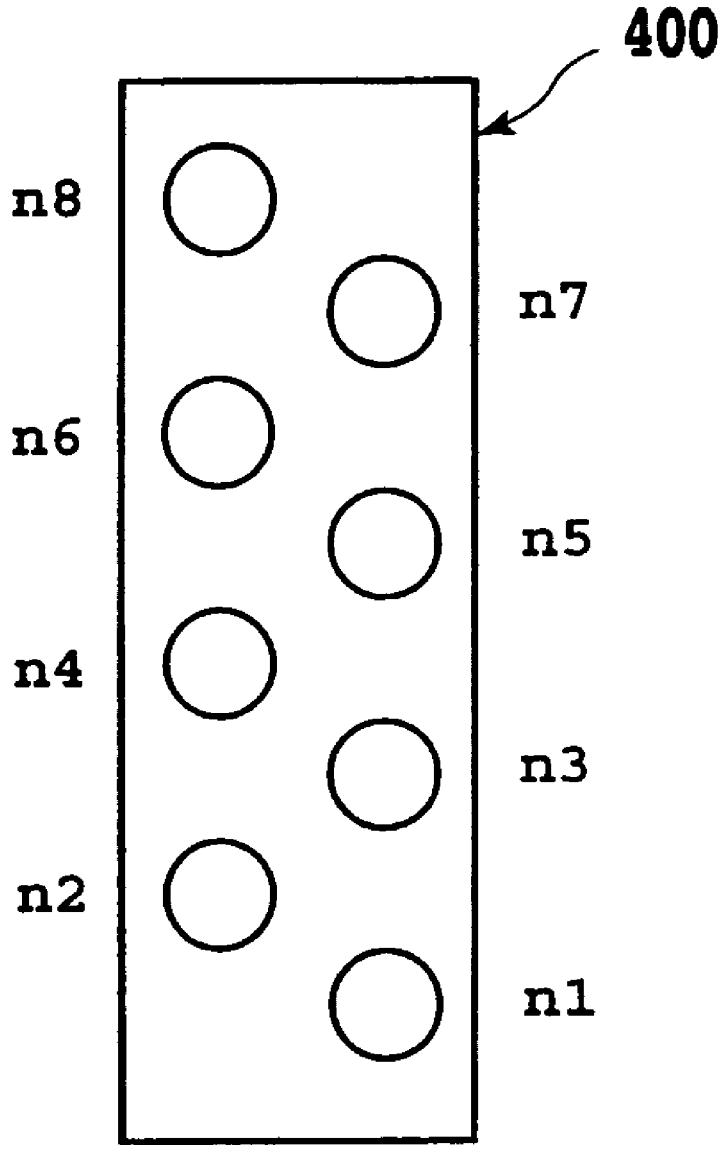
FIG. 15 is a configuration diagram of a printing head used in the fourth embodiment of the present invention.

FIG. 15 shows an ink ejection port forming surface of the printing head 400 of the present embodiment which can eject only ink droplets in a certain size. The head is used for a black ink in the present embodiment. The printing head 400 has two rows of ejection ports each consisting of four ejection ports (four nozzles) (n) for achieving a density of 300 (N) dots per inch (300 dpi) in a sub-scanning direction that is orthogonal to a main scanning direction. Therefore, the head has eight ejection ports (eight nozzles), which are in a staggered configuration, in total. In the printing head 400, the positions of the two rows of ejection ports are offset from each other by 600 dpi in the sub-scanning direction. The nozzle numbers n1, n2, n3, n4, n5, n6, and n7 shown in FIG. 15 represent respective ink ejection ports, and the rows of ejection ports are constituted by a group of ink ejection ports of one type having the same ejecting aperture. The size of ink droplets ejected from the ejection ports is 30 (pl), and one heater for ejecting ink is provided in each of regions which are in communication with the ink ejection ports.

Image data for black used for the printing head 400 in FIG. 15 is image data representing two levels using the pixel patterns (a) and (c) in FIG. 9.

Figure 16:
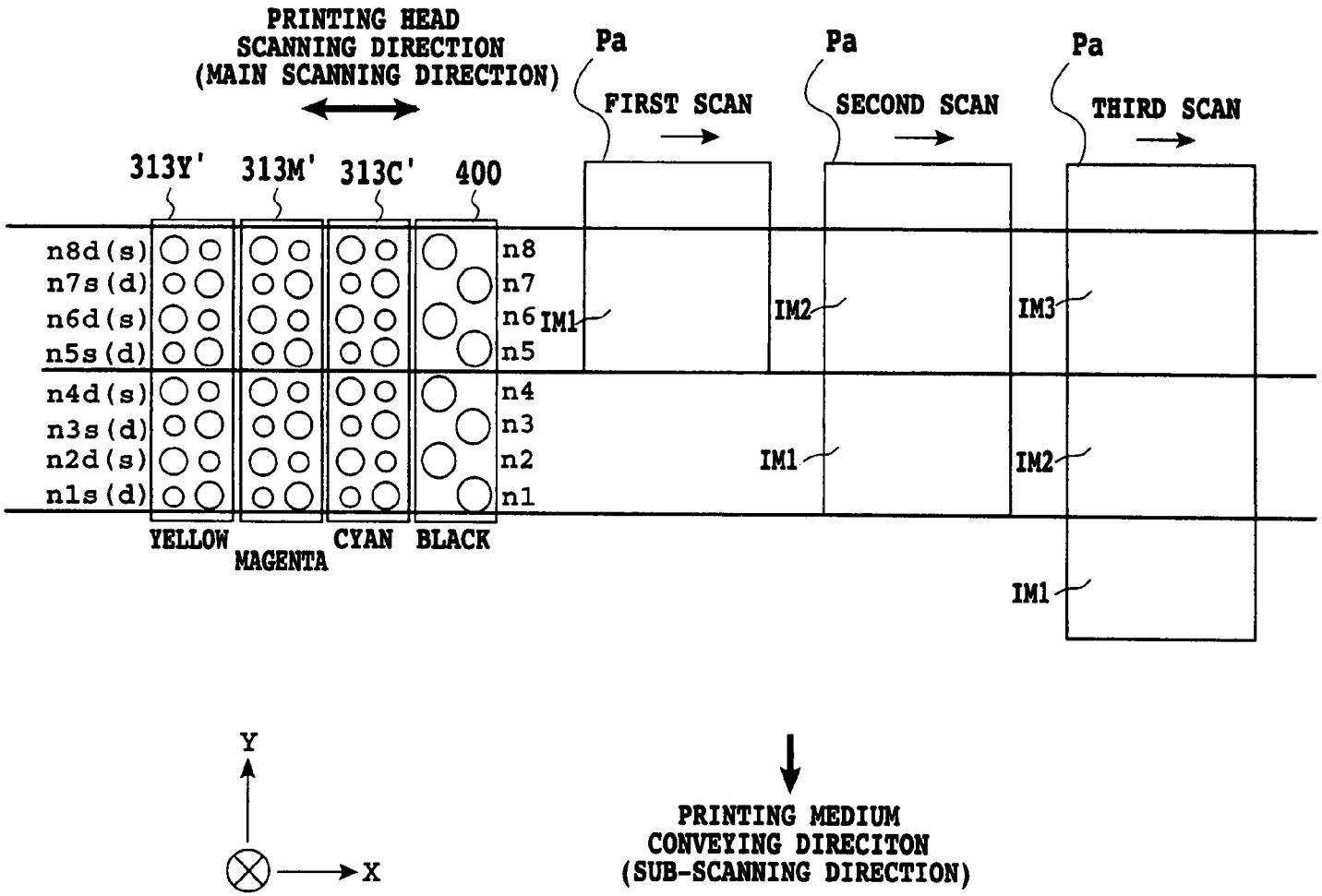
FIG. 16 is a schematic illustration of a printing operation in the fourth embodiment of the invention.

FIG. 16 is shown to explain the printing heads in the present embodiment and how printing is performed in one image by two scans.

Referring to FIG. 16, a printing medium Pa is conveyed in the sub-scanning direction by a conveying amount of 4/600 inches which is equivalent to one half of the combined width of all nozzles during a first scan. Thereafter, printing is performed in a forward direction based on image data having pixel patterns as shown in FIG. 9. In an image area IM1, printing heads 313C', 313M', and 313Y' for cyan, magenta, and yellow (see FIG. 8) perform printing using a group of ink ejection ports of a small aperture having nozzle numbers n5*s*, n6*s*, n7*s*, and n8*s* and a group of ink ejection ports of a large aperture having nozzle numbers n5*d*, n6*d*, n7*d*, and n8*d*. The printing head 400 for black shown in FIG. 15 performs printing using a group of ink ejection ports having nozzle numbers n5, n6, n7, and n8.

Referring to a second scan, the printing medium Pa is conveyed in the sub-scanning direction by a conveying amount of 4/600 inches similar to that in the first scan. Thereafter, in the image area IM1, the printing heads 313C', 313M', and 313Y' for cyan, magenta, and yellow (see FIG. 8) perform printing using a group of ink ejection ports of a small aperture having nozzle numbers n1*s*, n2*s*, n3*s*, and n4*s* and a group of ink ejection ports of a large aperture having nozzle numbers n1*d*, n2*d*, n3*d*, and n4*d*, and the printing head 400 for black shown in FIG. 15 performs printing using a group of ink ejection ports having nozzle numbers n1, n2, n3, and n4. In an image area IM2, the printing heads 313C', 313M', and 313Y' for cyan, magenta, and yellow perform printing in the forward direction using the group of ink ejection ports of a small aperture having nozzle numbers n5*s*, n6*s*, n7*s*, and n8*s* and the group of ink ejection ports of a large aperture having nozzle numbers n5*d*, n6*d*, n7*d*, and n8*d*, just as done during the first scan. The printing head 400 for black performs printing in the forward direction using the group of ink ejection ports having nozzle numbers n5, n6, n7, and n8.

Printing proceeds in third and subsequent scans in the same way as in the second scan.

Referring to an arrangement of pixels of image data, comprising pixel patterns as shown in FIG. 9, to be recorded by a printing operation as explained with reference to FIG. 16 according to the present embodiment, reference is to be made to (a) and (b) of FIG. 11 for explanation of such an arrangement with respect to the printing heads 313C', 313M', and 313Y' for cyan, magenta, and yellow shown in FIG. 8. The explanation for the group of ink ejection ports for ejecting large dots of the printing head shown in FIG. 11(*a*) equally applies to the printing head 400 for black shown in FIG. 15.

During the first scan, the printing heads 313C', 313M', and 313Y' for cyan, magenta, and yellow shown in FIG. 8 perform printing through an operation of repeating a sequence of ejection of large dots, no ejection, ejection of large dots, no ejection, no ejection, ejection of small dots, no ejection, ejection of small dots, and then no ejection for respective columns in terms of units of ejection (1200 dpi) as described above. The printing head 400 for black shown in FIG. 15 performs printing through an operation of repeating a sequence excluding ejection of small dots, i.e., a sequence of ejection of large dots, no ejection, ejection of large dots, no ejection, no ejection, no ejection, no ejection, no ejection, and no ejection.

During the second scan, the printing heads 313C', 313M', and 313Y' for cyan, magenta, and yellow shown in FIG. 8 perform printing through an operation of repeating a sequence of no ejection, ejection of small dots, no ejection, ejection of small dots, ejection of large dots, no ejection, ejection of large dots, no ejection, and then no ejection for the respective columns in terms of units of ejection (1200 dpi). The printing head 400 for black shown in FIG. 15 performs printing through an operation of repeating a sequence excluding ejection of small dots, i.e., a sequence of no ejection, no ejection, no ejection, no ejection, ejection of large dots, no ejection, ejection of large dots, no ejection, and no ejection.

Printing is performed during the third and subsequent scans in the same manner as in the first and second scans.

In the present embodiment employing the printing head 400 ejecting only ink droplets in a certain size, just as in the first, second, and third embodiments, printing of each column in terms of units of ejection (1200 dpi) during one main scan involves only any one of ejection of large dots from the group of large apertures of the row of ejection ports, ejection of small dots from the group of small apertures, and ejection of no ink. Thus, there is no need for distinguish data for the group of large apertures from data for the group of small apertures in a memory configuration for the image data. Further, the memory capacity may be reduced by the amount of data to be otherwise reserved for columns for which no ejection takes place. It is therefore possible to employ a configuration in which the amount of a memory to be used as a print buffer can be one half or less of that in the related art or less.

In the present embodiment employing the printing head 400 ejecting only ink droplets in a certain size, it holds true again that printing in a column in terms of units of ejection (1200 dpi) during one main scan is performed using only either the group of ejection ports for ejecting large dots constituting a group of large apertures or the group of ejection ports for ejecting small dots constituting a group of small apertures. It is therefore possible to employ a configuration in which the power to drive the heads can be substantially halved from that in the related art.

Further, the combination and sequence shown in (a) and (b) of FIG. 11 may be employed for printing performed using all of the four printing heads, i.e., the printing head 400 ejecting black ink in the form of ink droplets in a certain size and the printing head 313C', printing head 313M', and printing head 313Y' ejecting ink droplets having different sizes in cyan, magenta, and yellow, respectively. However, such an example is not limiting the invention and, for example, two of the printing heads may be driven in a combination and sequence different from that for other colors by using the combination and sequence for the second scan shown in FIG. 11(*a*) for the first scan in the present embodiment or using the combination and sequence for the first scan shown in FIG. 11(*a*) for the first scan of in the present embodiment conversely. The maximum power consumption can be halved in such a way.

In the present embodiment, image data used for the printing heads as shown in FIG. 8 is represented in four levels by the pixel patterns in FIG. 9. However, this is not limiting the invention. The invention is not limited to the printing operation described above with reference to FIG. 16 and the combinations and sequences for ejecting ink droplets in arrangements of pixels of image data different from that shown in FIG. 11(*a*). The number of quantization, pixel patterns, the number of printing scans to complete an image, and the combination and sequence of ejections of different ink droplets may be optimized depending on the printing medium used and image quality to be achieved.

Depending on the printing medium used and image quality to be achieved, printing may be performed at a high speed in a second printing mode if available, the second printing mode being a mode in which printing is performed based on image data represented in two levels with the pixel patterns (a) and (c) in FIG. 9 used for the printing head 400 shown in FIG. 15 ejecting only ink droplets in a certain size and based on image data involving only large dots represented in two levels using the pixel patterns (a) and (c) shown in FIG. 9 among the data used for the printing heads as shown in FIG. 8.

According to the present embodiment, as described above, there is a plurality of printing heads for respective inks in different ink colors, at least the printing head for one color being a printing head capable of ejecting ink droplets in different sizes, at least the printing head for one color being a printing head capable of ejecting only ink droplets in a certain size. Even in such a case, plural types of ink droplets in different sizes can be selectively used for printing in one main scan to complete an image, using the printing head capable of ejecting ink droplets in different sizes. It is therefore possible to select an optimum combination of ink droplets depending on the printing medium used and image quality to be achieved, thereby allowing an uniform image without density irregularities to be provided. Further, since the amount of use of a memory of a printing system and the amount of power to drive heads can be minimized, the printing apparatus can be provided at a low cost and in a small size.

Other Embodiments

Although the size of ink droplets ejected from ink ejection ports is varied by employing ink ejection ports having different apertures in the above-described embodiments, the invention is not limited to such embodiments. For example, the same purpose may alternatively be achieved by changing the size of the heaters or changing conditions for the application of a driving pulse to the heaters.

While the above-described embodiments employ printing heads which eject ink droplets using heaters for generating thermal energy, the invention is not limited to printing heads of this type, and it is possible to use printing heads which employ an ejection method utilizing a piezoelectric element.

The above-described embodiments are examples of application of the invention to printing heads comprising groups of ejection ports of two types for ejecting small ink droplets from a group of small apertures in a row of ejection ports and ejecting large ink droplets from a group of large apertures. The invention is not limited to ink droplets in two sizes and may be applied to recoding heads configured to eject ink droplets in three or more sizes.

It is possible to employ different types of printing heads which can eject ink droplets in different sizes in each ink color. A configuration including a plurality of heaters provided in a region in communication to one ejection port may be employed to vary the size of ink droplets from the ejection port by using the heaters selectively. Further, in the case of a head utilizing a piezoelectric element, energy applied to the piezoelectric element may be controlled to vary the size of ink droplets.

Although printing is performed only in a forward direction in the above-described embodiment, printing may be performed also in a backward direction.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2003-411062 filed Dec. 9, 2003, which is hereby incorporated by reference herein.

What is claimed is:

1. An ink jet printing apparatus which performs printing by ejecting different amounts of ink onto a printing medium so as to form dots of different sizes on the printing medium, said apparatus comprising:

a plurality of pixel patterns each representing an arrangement of dots of different sizes forming one pixel, the dots having different dot diameters, each of the pixel patterns indicating a dot arrangement corresponding to data representing a value of levels;

image data processing means which quantizes image data into the data representing a value of levels, said image data processing means processing the quantized image data into image data representing the arrangements of dots corresponding to the dots of different sizes in accordance with the pixel pattern corresponding to the value of levels regarding the quantized image data;

a printing head having a plurality of ejection ports for forming the dots of different sizes, said printing head provided with an ejection port array in which first ejection ports for forming relatively large dots and second ejection ports for forming relatively small dots are alternatively arranged in a single line in a longitudinal direction of said printing head;

scanning means for scanning, in a scan direction, said printing head relative to the printing medium; and printing means which causes said printing head to print the dots of different sizes based on the image data provided by said image data processing means, the data representing an arrangement of dots corresponding to the dots of different sizes, wherein each pixel pattern causes a printing position in the scan direction of a relatively large dot among the dots of different sizes to differ from a printing position in the scan direction of a relatively small dot among the dots of different sizes such that ink droplets for forming relatively large dots are not ejected simultaneously with ink droplets for forming relatively small dots, the printing positions in the scan direction of the relatively large dots being in same columns between different rasters.

2. The ink jet printing apparatus according to claim 1, wherein each pixel pattern is set corresponding to data quantized in a plurality of levels and an arrangement of dots having different dot diameters differs according to the level of quantization.

3. The ink jet printing apparatus according to claim 1 or 2, wherein said image data processing means selects the pixel pattern according to the type of printing medium and an image quality to be achieved.

4. The ink jet printing apparatus according to claim 1, wherein the first ejection ports ejecting a greater amount of ink and the second ejection ports ejecting a smaller amount of ink are alternately arranged on the printing head and wherein each pixel pattern is formed by combining relatively large dots formed by ink droplets ejected from the first ejection ports and relatively small dots formed by ink droplets ejected from the second ejection ports.

5. The ink jet printing apparatus according to claim 4, wherein each pixel pattern comprises a missing dot, only a relatively small dot, only a relatively large dot, or a relatively large dot and a relatively small dot, depending on the value of levels.

6. The ink jet printing apparatus according to claim 1, wherein said printing head has an ejection port array for ink in each color ejected thereby and wherein the ejection port array constituted only by ejection ports for ejecting ink droplets forming dots of a certain size is used for a certain ink.

7. The ink jet printing apparatus according to claim 6, wherein the dots of the certain size are greatest in dot diameter compared to dots of other sizes.

8. The ink jet printing apparatus according to claim 1, wherein the image data is thinned out using a predetermined mask pattern such that an image is completed in one area of the printing medium by a plurality of scans of said printing head.

9. The ink jet printing apparatus according to claim 1, wherein a combination and sequence of a plurality of dots having different dot diameters formed during one scan vary depending on the pixel pattern used.

10. The ink jet printing apparatus according to claim 1, wherein bubbles are generated in ink to eject ink droplets from the ejection ports by using pressure generated by the bubbles.

11. An ink jet printing method using an ink jet printing apparatus which performs printing by ejecting different amounts of ink onto a printing medium so as to form dots of different sizes onto the printing medium, said method comprising:

a pixel patterning step for obtaining a plurality of pixel patterns each representing an arrangement of dots of different sizes forming one pixel, the dots having different dot diameters, each of the pixel patterns indicating a dot arrangement corresponding to data representing a value of levels;

an image data processing step for quantizing image data into the data representing a value of levels, said image data processing step processing the quantized image data into image data representing arrangements of dots corresponding to the dots of different sizes in accordance with the pixel pattern corresponding to the value of levels regarding the quantized image data; and a printing step for causing a printing head, while scanning the printing head in a scan direction, to print dots of different sizes based on the image data provided in said image data processing step, the data representing an arrangement of dots corresponding to the dots of different sizes, the printing head having a plurality of ejection ports for forming the dots of different sizes, the printing head provided with an ejection port array in which first ejection ports for forming relatively large dots and second ejection ports for forming relatively small dots are alternately arranged in a single line in a longitudinal direction of the printing head, wherein each pixel pattern causes a printing position in the scan direction of a relatively large dot among the dots of different sizes to differ from a printing position in the scan direction of a relatively small dot such that ink droplets for forming relatively large dots are not ejected simultaneously with ink droplets for forming relatively small dots, the printing positions in the scan direction of the relatively large dots being in same columns between different rasters.

12. The ink jet printing method according to claim 11, wherein each pixel pattern is set corresponding to data quantized in a plurality of levels and an arrangement of dots having different dot diameters differs according to the level of quantization.

13. The ink jet printing method according to claim 11 or 12, wherein the pixel pattern is selected at said image data processing step according to the type of printing medium and an image quality to be achieved.

14. The ink jet printing method according to claim 11, wherein the first ejection ports ejecting a greater amount of ink and the second ejection ports ejecting a smaller amount of ink are alternately arranged on the printing head and wherein each pixel pattern is formed by combining relatively large dots formed by ink droplets ejected from the the first ejection ports and relatively small dots formed by ink droplets ejected from the second ejection ports.

15. The ink jet printing method according to claim 14, wherein each pixel pattern comprises a missing dot, only a relatively small dot, only a relatively large dot, or a relatively large dot and a relatively small dot, depending on the value of levels.

16. The ink jet printing method according to claim 11, wherein the printing head has an ejection port array for ink in each color ejected thereby and wherein an ejection port array constituted only by ejection ports for ejecting ink droplets forming dots of a certain size is used for a certain ink.

17. The ink jet printing method according to claim 16, wherein the dots of the certain size are greatest in dot diameter compared to dots of other sizes.

18. The ink jet printing method according to claim 11, wherein the image data is thinned out using a predetermined mask pattern such that an image is completed in one area of the printing medium by a plurality of scans of the printing head.

19. The ink jet printing method according to claim 11, wherein a combination and sequence of a plurality of dots having different dot diameters formed during one scan vary depending on the pixel pattern used.

* * * * *